US012714240B2

(12) United States Patent
Mo et al.

(10) Patent No.: US 12,714,240 B2
(45) Date of Patent: Aug. 25, 2026

(54) FOLDING MECHANISM

(71) Applicant: BAMBINO PREZIOSO SWITZERLAND AG, Steinhausen (CH)

(72) Inventors: Xiaolong Mo, Dongguan (CN); Kun Zhang, Dongguan (CN)

(73) Assignee: BAMBINO PREZIOSO SWITZERLAND AG, Steinhausen (CH)

( * ) Notice: Subject to any disclaimer, the term of this patent is extended or adjusted under 35 U.S.C. 154(b) by 238 days.

(21) Appl. No.: 18/568,697

(22) PCT Filed: Jun. 10, 2022

(86) PCT No.: PCT/EP2022/065872
§ 371 (c)(1),
(2) Date: Dec. 8, 2023

(87) PCT Pub. No.: WO2022/258822
PCT Pub. Date: Dec. 15, 2022

(65) Prior Publication Data

US 2024/0268571 A1 Aug. 15, 2024

(30) Foreign Application Priority Data

Jun. 10, 2021 (CN) ..... 202110650502.9

(51) Int. Cl.
*A47D 13/02* (2006.01)

(52) U.S. Cl.
CPC ..... *A47D 13/027* (2022.08)

(58) Field of Classification Search
CPC ..... A47D 13/027; A47D 13/02; A47D 1/103; B60N 2002/2896
(Continued)

(56) References Cited

U.S. PATENT DOCUMENTS 4,602,395 A 7/1986 Kassai
5,395,154 A 3/1995 Wang
(Continued)

FOREIGN PATENT DOCUMENTS

CA 2469501 A1 11/2004
CN 2877469 Y * 3/2007
(Continued)

OTHER PUBLICATIONS

International Search Report for International Application No. PCT/EP2022/065872; International Filing Date: Jun. 10, 2022; Date of Mailing: Dec. 12, 2022; 5 pages.
(Continued)

*Primary Examiner* — Jose V Chen
(74) *Attorney, Agent, or Firm* — CANTOR COLBURN LLP

(57) ABSTRACT

The present disclosure provides a folding mechanism suitable for a baby carrier. The baby carrier includes a first part and a second part. The first part and the second part are arranged in a longitudinal direction. The folding mechanism includes a connecting element. The second part is movably connected to the first part through the connecting element, and an extending direction of the connecting element is parallel to the longitudinal direction.

21 Claims, 32 Drawing Sheets

(58) Field of Classification Search
USPC ..... 297/255, 256
See application file for complete search history.

(56) References Cited

U.S. PATENT DOCUMENTS

| | | | | |
|---|---|---|---|---|
| 9,138,070 | B1 | 9/2015 | Shamie et al. | |
| 2007/0006910 | A1 | 1/2007 | Chu et al. | |
| 2019/0335917 | A1 | 11/2019 | Taylor et al. | |
| 2020/0405073 | A1* | 12/2020 | Clemmer | A47D 9/012 |
| 2021/0347403 | A1* | 11/2021 | Yi | A47D 9/016 |
| 2023/0165386 | A1* | 6/2023 | Hartenstine | A47D 9/016 297/130 |
| 2023/0365180 | A1* | 11/2023 | Yuan | A47D 13/027 |
| 2024/0000241 | A1* | 1/2024 | Cheng | A47D 9/00 |

FOREIGN PATENT DOCUMENTS

| | | | | | |
|---|---|---|---|---|---|
| CN | 1960662 | A | | 5/2007 | |
| CN | 101856183 | A | | 10/2010 | |
| CN | 201840125 | U | | 5/2011 | |
| CN | 102458191 | A | | 5/2012 | |
| CN | 103448775 | A | | 12/2013 | |
| CN | 204670787 | U | | 9/2015 | |
| CN | 104970622 | A | | 10/2015 | |
| CN | 204838811 | | * | 12/2015 | |
| CN | 204838811 | U | | 12/2015 | |
| CN | 205144059 | U | | 4/2016 | |
| CN | 105996587 | A | * | 10/2016 | A47D 13/02 |
| CN | 106490883 | A | * | 3/2017 | A47D 13/02 |
| CN | 206141604 | U | | 5/2017 | |
| CN | 107898218 | A | | 4/2018 | |
| CN | 108113337 | A | | 6/2018 | |
| CN | 208463423 | U | | 2/2019 | |
| CN | 109497772 | A | | 3/2019 | |
| CN | 209202565 | U | | 8/2019 | |
| CN | 110811219 | A | | 2/2020 | |
| CN | 110833350 | A | | 2/2020 | |
| CN | 111012107 | A | | 4/2020 | |
| CN | 210300368 | U | | 4/2020 | |
| CN | 213097171 | U | | 5/2021 | |
| DE | 202004008567 | U1 | | 9/2004 | |
| EP | 1481616 | A1 | | 12/2004 | |
| EP | 3831247 | A1 | | 6/2021 | |
| GB | 202009587 | | | 8/2020 | |
| JP | S6124267 | B2 | | 2/1986 | |
| JP | S6124267 | U1 | | 2/1986 | |
| JP | 1532411 | S | | 7/2015 | |
| JP | 2016101309 | A | | 6/2016 | |
| JP | 2017038806 | A | | 2/2017 | |
| JP | 2019072089 | A | | 5/2019 | |
| JP | 2019213626 | A | | 12/2019 | |
| WO | 2014071987 | A1 | | 5/2014 | |
| WO | 2015197200 | A1 | | 12/2015 | |
| WO | 2018150368 | A1 | | 8/2018 | |
| WO | WO-2018150368 | | * | 8/2018 | |

OTHER PUBLICATIONS

Taiwanese Application No. 111121351; Office Action dated Feb. 20, 2023; 6 pages.
Written Opinion for International Application No. PCT/EP2022/065872; International Filing Date: Jun. 10, 2022; Date of Mailing: Dec. 12, 2022; 9 pages.
Taiwanese Application No. 113137670; Office Action dated Dec. 27, 2024; 14 pages.
Chinese Application No. 2021106505029; 2nd Office Action with English translation dated Sep. 30, 2024; 23 pages.
Japanese Application No. 2023-576115; Notice of Reasons for Refusal with English translation dated Nov. 1, 2024; 12 pages.
CN 1st Office Action; Application No. 112133501; Mailing Date: Dec. 11, 2023; pp. 1-8.
CN 1st Office Action with English Translation; Application No. 202110650502.9; Date Mailed: May 10, 2024; pp. 1-22.
EP Communication Pursuant to Article 94(3) EPC; Application No. 22733057.8-1015; Date Mailed: Mar. 28, 2025; pp. 1-8.
Taiwanese Application No. 113137670; Notice of Allowance dated Apr. 21, 2025 pp. 1-11.
CN 1st Office Action with English Translation; App No. 114127545; Date Mailed: Nov. 17, 2025; pp. 1-19.
JP Office Action with English Translation; JP App No. 2025-106158; Date Mailed: Jul. 14, 2026; pp. 1-4.

* cited by examiner

FOLDING MECHANISM

CROSS-REFERENCE TO RELATED APPLICATIONS

The present application is a national phase application under 35 U.S.C. 371 of International Application No. PCT/EP2022/065872 filed on Jun. 10, 2022, and claims priority to Chinese application No. 202110650502.9 filed Jun. 10, 2021, the entire contents of which are incorporated herein by reference.

TECHNICAL FIELD

The present disclosure relates to the technical field of baby products, in particular to a folding mechanism capable of simply folding a baby carrier.

BACKGROUND

Baby carriers are common baby-related products on the market, such as sleeping boxes, cribs, cradle or the like. Generally, a baby carrier includes a frame body for carrying a baby, a bracket body for supporting the frame body, a cloth cover laid on the frame, a handle which is convenient for a user to hold, and other components. When it is used by a baby, the components are fixed to each other to ensure that the whole carrier will not collapse due to movement of the baby, such as turning over or rolling, or external disturbance.

However, when the baby carrier is not used, a volume of the baby carrier which is kept in a use state is large, and therefore, it is not only unfavorable for carrying, but also tends to occupy large room space. In order to facilitate the baby carrier to be carried and stored, it is necessary to provide a folding mechanism that is capable of folding different parts of the baby carrier to reduce its volume.

SUMMARY

An objective of the present disclosure is to provide a folding mechanism for easily folding a baby carrier.

In order to achieve the above objective, the present disclosure provides a folding mechanism, which is suitable for a baby carrier. The baby carrier includes a first part and a second part, and the first part and the second part are arranged in a longitudinal direction. The folding mechanism includes a connecting element, wherein the second part is movably connected to the first part through the connecting element, and an extending direction of the connecting element is parallel to the longitudinal direction.

Preferably; each of the first part and the second part includes a bottom plate, and the connecting element is pivotally connected to the bottom plate of the first part and the bottom plate of the second part, respectively.

Preferably, a length of the second part in the longitudinal direction is less than or equal to a length of the first part in the longitudinal direction. An accommodating groove is formed on the bottom plate of the first part, and is recessed relative to an upper surface of the bottom plate of the first part. A through groove is provided on the bottom plate of the second part, and is communicated with an upper surface and a lower surface of the bottom plate of the second part. The connecting element penetrates through the accommodating groove and the through groove.

Preferably, the folding mechanism further includes a first limit element and a second limit element, wherein the first limit element and the second limit element are respectively fixed, pivoted or clamped on the bottom plate of the first part and the bottom plate of the second part, and the connecting element is sleeved on the first limit element and the second limit element.

Preferably, the length of the second part in the longitudinal direction is less than or equal to the length of the first part in the longitudinal direction. Each of the first part and the second part further includes a side wall, and each side wall surrounds the corresponding bottom plate. The folding mechanism is adapted to switch the baby carrier between an unfolded state and a folded state, the bottom plate of the second part is abutted against and coplanar with the bottom plate of the first part in the unfolded state, and the bottom plate and the side wall of the second part are respectively superposed on the bottom plate and the side wall of the first part in the folded state.

Preferably, the folding mechanism further includes a connecting hole. Each of the first part and the second part includes an end face, the connecting element is fixedly disposed on one of the first part and the second part and protrudes relative to the corresponding end face, the connecting hole is formed on the end face of the other of the first part and the second part, and the number and position of the connecting hole correspond to those of the connecting element.

Preferably, the length of the second part in the longitudinal direction is less than or equal to the length of the first part in the longitudinal direction. The connecting element is fixedly disposed on the second part, and a length of the connecting element protruding relative to the end face of the second part is less than a length difference between the first part and the second part in the longitudinal direction.

Preferably, each of the first part and the second part includes a bottom plate and a side wall, and each side wall surrounds the corresponding bottom plate. The connecting element is disposed outside of at least one of the bottom plate and the side wall of the second part and includes a sliding portion, at least one of the bottom plate and the side wall of the first part is formed with a sliding rail or sliding groove, and the sliding portion is slidably disposed on the sliding rail or sliding groove.

Preferably, the folding mechanism further includes an operating element and at least one locking element. The operating element is arranged on one of the first part and the second part and is formed with at least one limit groove, and the at least one locking element includes a locking portion and a limit portion. The limit portion is slidably disposed in the limit groove, the other of the first part and the second part is formed with a plurality of locking holes, and the locking portion is selectively clamped in these locking holes.

Preferably; the folding mechanism further includes an elastic element, the locking element and the limit groove are provided in plural, and the elastic element is arranged between the operating element and the plurality of locking elements.

Preferably, an extending direction of the locking element is inclined relative to the longitudinal direction, and an extending direction of the limit groove is inclined relative to the longitudinal direction and the extending direction of the locking element.

Preferably, the operating element is disposed outside of the bottom plate of the second part, an accommodating groove is formed on the bottom plate of the first part, these locking holes are arranged on a side of the accommodating groove, and a driving element and the locking element are slidably disposed in the accommodating groove.

Preferably, the connecting element further includes a fixing portion, wherein the sliding portion is pivotally connected to the fixing portion, and the connecting element is fixedly disposed outside of at least one of the bottom plate and the side wall of the second part through the fixing portion.

In addition, the present disclosure also provides another folding mechanism for a baby carrier. The baby carrier includes a first part and a second part. The first part includes a base portion and a plurality of folding portions. The plurality of folding portions are pivotally connected to the base portion, and the base portion, at least one of the folding portions and the second part are sequentially arranged in a longitudinal direction. The folding mechanism includes a connecting element, wherein the second part is slidably connected to the base portion through the connecting element, and an extending direction of the connecting element is parallel to the longitudinal direction.

Preferably, the folding mechanism further includes a locking element, a driving element and an operating element. The locking element is pivotally connected to one of the folding portions and includes an extending portion and a bending portion, wherein the extending portion is formed with a limit feature thereon, and the bending portion is bent relative to the extending portion. The second part includes a locking portion, and the bending portion is selectively clamped to the locking portion. The driving element is arranged on the folding portion and formed with a limit groove, and the limit feature is slidably disposed in the limit groove. The operating element is connected to the driving element and protrudes or recesses relative to a surface of the folding portion.

Preferably; the folding mechanism further includes an elastic element, and the elastic element is arranged between the folding portion and the driving element.

Preferably, the baby carrier further includes a handle, the handle is formed with a positioning portion, and an end of the driving element is selectively clamped to the positioning portion.

Preferably, the folding portion is formed with a first accommodating space, a second accommodating space and a sliding groove, the second accommodating space is arranged at a side of the folding portion, the sliding groove is communicated with the first accommodating space and the second accommodating space, a part of the handle penetrates through the first accommodating space, the driving element is slidably disposed in the sliding groove, and at least a part of the locking portion is accommodated in the second accommodating space.

Preferably, an extending direction of the sliding groove is parallel to the longitudinal direction.

Preferably, the driving element and the locking element are embedded inside the folding portion.

Preferably, the connecting element is a pipe element and includes a first pipe and a second pipe, wherein the first pipe is arranged at the base portion and formed with a cavity, and the second pipe is connected to the second part and slidably disposed in the cavity.

Preferably, the first pipe is embedded inside the base portion.

BRIEF DESCRIPTION OF THE DRAWINGS

The present disclosure will be more apparent from the following description in combination with the accompanying drawings, which are used to explain the embodiments of the present disclosure.

LIST OF REFERENCE NUMBERS

Folding Mechanism 1, 1*a*, 1*b*, 1*c*, 1*d*
First Connecting Element 100
Connecting Element 100*a*, 100*b*, 100*c*, 100*d*
Accommodating Groove 110
Sliding Portion 110*c*
First Pipe 110*d*
Cavity 112*d*
Limit Hole 120
Fixing Portion 120*c*
Second Pipe 120*d*
Second Connecting Element 200
First Limit Element 200*a*
Locking Element 300
Second Limit Element 300*a*
Driving Element 300*d*
Limit Portion 310
Limit Groove 310*c*, 310*d*
Cambered Surface 312
Through Hole 320
Operating Element 300*c*, 400, 400*d*
Cover 400*c*
Operating Portion 410
Penetrating Portion 420
Positioning Element 500
Locking Element 500*c*, 500*d*
Positioning Portion 510
Locking Portion 510*c*
Extending Portion 510*d*
Limit Feature 512*d*
Limit portion 520*c*
Bending Portion 520*d*
Elastic Element 600, 600*c*, 600*d*
Limit Element 700
First Auxiliary Connector 800
Second Auxiliary Connector 900
Stopper 910
Baby Carrier 2, 2*a*, 2*b*, 2*c*, 2*d*
First Part 10, 10*a*, 10*b*, 10*c*, 10*d*
Bottom Plate 12*a*, 12*b*, 12*c*
Base Portion 12*d*
Side Wall 14*a*, 14*b*, 14*c*
Folding Portion 14*d*
End Face 16*b*
Pivot 16*d*
Guide Post 18*c*
Second Part 20, 20*a*, 20*b*, 20*c*, 20*d*
Bottom Plate 22*a*, 22*b*, 22*c*
Locking Portion 22*d*
Side Wall 24*a*, 24*b*, 24*c*
End Face 26*b*
Handle 30, 30*a*, 30*b*, 30*d*
Clamping Portion 32*d*
Area A
Accommodating Groove G
Connecting Hole H
Sliding groove J
Longitudinal Direction L
Locking Hole P
Sliding Rail R
Accommodating Space S
First Accommodating Space S1
Second Accommodating Space S2
Through Groove T

DETAILED DESCRIPTION

Embodiments of the present disclosure will now be described with reference to the accompanying drawings, in which like reference numbers represent like components.

Figure 1:
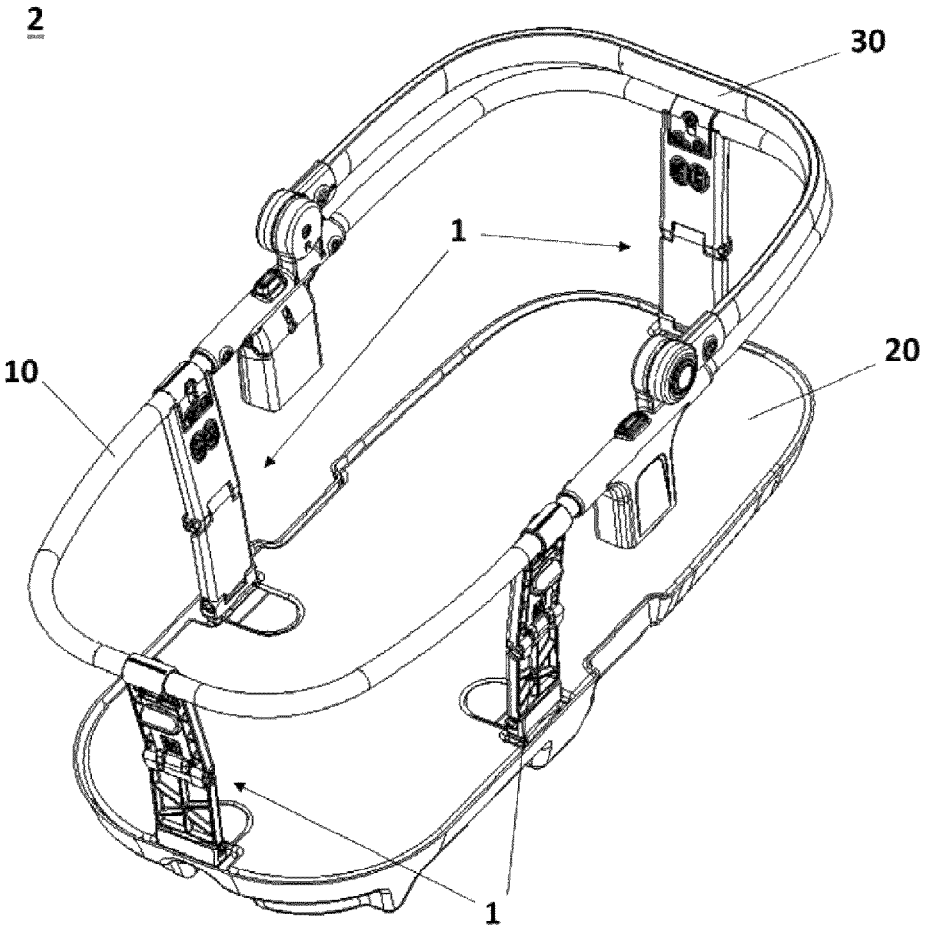
FIG. 1 is a perspective schematic view of a baby carrier in an unfolded state to which folding mechanisms according to a first embodiment of the present disclosure are applied.

Referring to FIG. 1, FIG. 1 is a perspective schematic view of a baby carrier in an unfolded state to which folding mechanisms according to the first embodiment of the present disclosure are applied. The folding mechanism 1 of the present embodiment is suitable for a baby carrier 2. The baby carrier 2 is a portable sleeping box or cradle, and includes a first part 10, such as an armrest or an upper frame of the sleeping box, and a second part 20, such as a box body or a lower frame of the sleeping box, arranged opposite to the first part 10. Preferably, the baby carrier 2 further includes a handle 30, wherein the handle 30 is connected to the first part 10, and can be held by a user to facilitate carrying the baby carrier 2.

Figure 2:
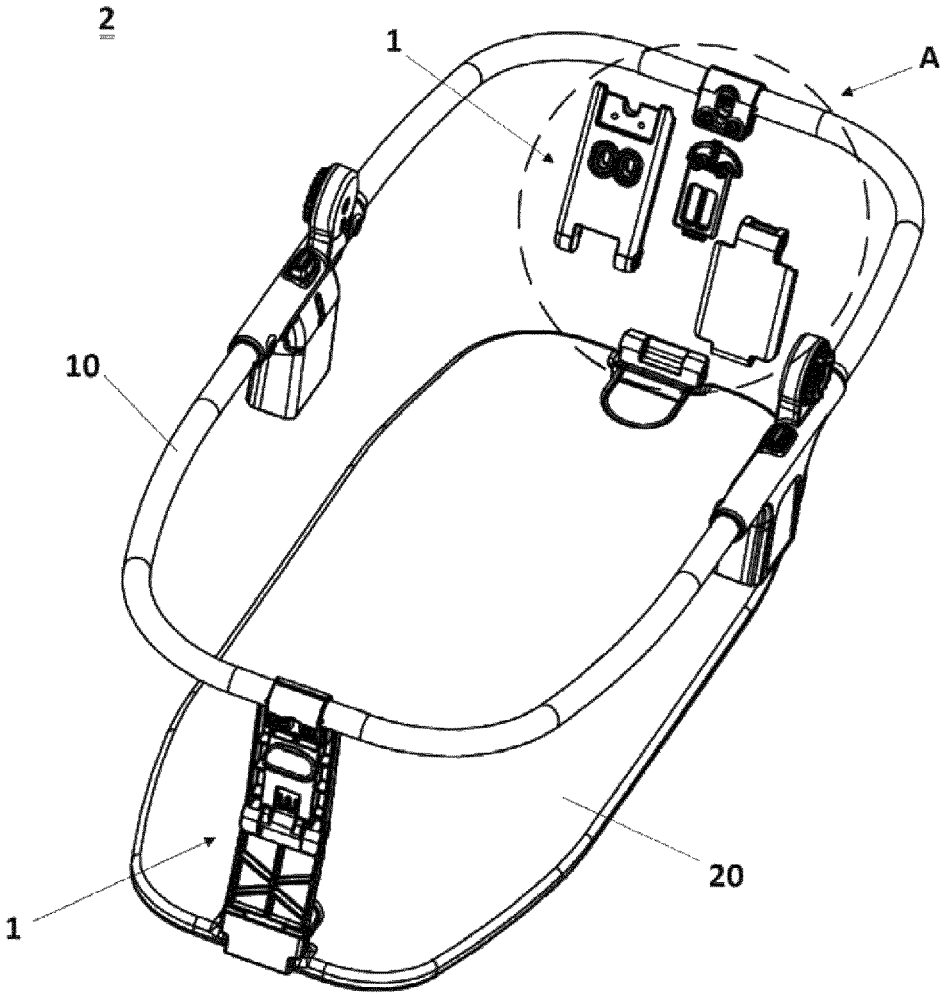
FIG. 2 is an exploded view of some components of the baby carrier of FIG. 1.
Figure 3:
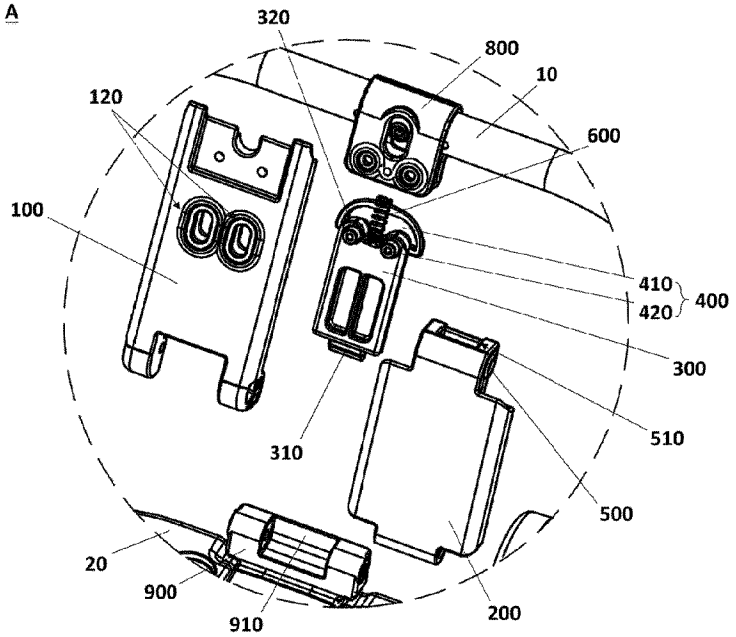
FIG. 3 is an enlarged schematic view of an area A in FIG. 2.

Referring to FIGS. 2 and 3 together, FIG. 2 is an exploded view of some components of the baby carrier of FIG. 1, and FIG. 3 is an enlarged schematic view of an area A in FIG. 2. As shown in FIG. 1, in this embodiment, the baby carrier 2 is equipped with four folding mechanisms 1, which are respectively arranged in front, rear, left and right directions of the baby carrier 2 and located between the first part 10 and the second part 20. These folding mechanisms 1 are used to lock the baby carrier 2 in an unfolded state where the first part 10 and the second part 20 are opposite to each other or fold the baby carrier into a folded state where the first part 10 and the second part 20 are adjacent to each other. It is worth mentioning that, according to the actual requirements, the baby carrier 2 may also be provided with only one folding mechanism 1 respectively at the front and rear as shown in FIG. 2, or even only one folding mechanism 1 respectively at one of the front, rear, left and right ends, which is not limited by the present disclosure. As shown in FIG. 3, each of the folding mechanisms 1 includes a first connecting element 100, a second connecting element 200, a locking element 300, an operating element 400 and a positioning element 500, wherein the first connecting element 100 is pivotally connected to the first part 10, the second connecting element 200 is pivotally connected to the second part 20, the locking element 300 is arranged on the first connecting element 100, the operating element 400 is fixed relative to the locking element 300, and the positioning element 500 is arranged on the second connecting element.

Specifically, each of the folding mechanisms 1 further includes a first auxiliary connector 800 and a second auxiliary connector 900, wherein the first auxiliary connector 800, for example, is a metal sleeve sleeved on the first part 10 and fixedly disposed on the first connecting element 100, while the second auxiliary connector 900, for example, is a pivot seat fixedly disposed on the second part 20 and pivotally connected with the second connecting element 200. In other words, the first connecting element 100 is pivotally connected to the first part 10 through the first auxiliary connector 800, and the second connecting element 200 is pivotally connected to the second part through the second auxiliary connector 900. Specifically, the folding mechanisms 1 enables the baby carrier 2 to be switched between the unfolded state and the folded state by operating the locking element 300 to selectively clamp the positioning element 500 through the operating element 400. As shown in FIG. 3, the locking element 300 and the operating element 400 may be an integrally formed member, or they may be independent members. In this embodiment, the locking element 300 and the operating element 400 are independent from each other, wherein the locking element 300 includes a limit portion 310 and is formed with through hole(s) 320, and the operating element 400 includes an operating portion 410 and a penetrating portion 420. The operating portion 410 protrudes relative to a surface of the first connecting element 100, so that it may be easily grasped by a user. The penetrating portion 420 is, for example, a protruding column, and in this embodiment, two penetrating portions are provided and penetrate through the through holes 320 to fix the locking element 300 and the operating element 400 to each other. On the other hand, the positioning element 500 is formed with a positioning portion 510, wherein the positioning portion 510 is, for example, a groove, and has a shape corresponding to that of the limit portion 310, and the limit portion 310 is selectively clamped to the positioning portion 510.

Figure 4:
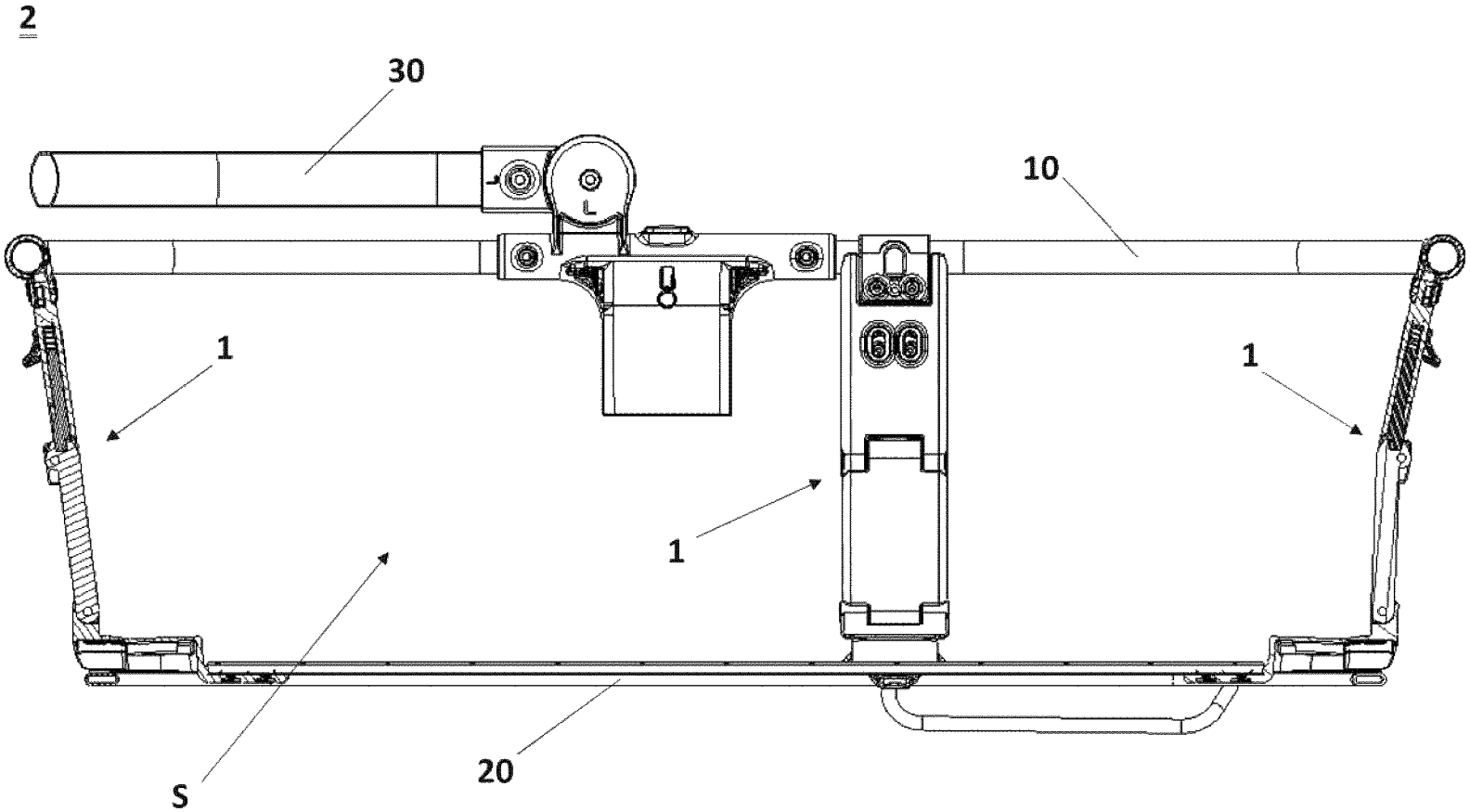
FIG. 4 is a schematic cross-sectional view of the baby carrier of FIG. 1.
Figure 5:
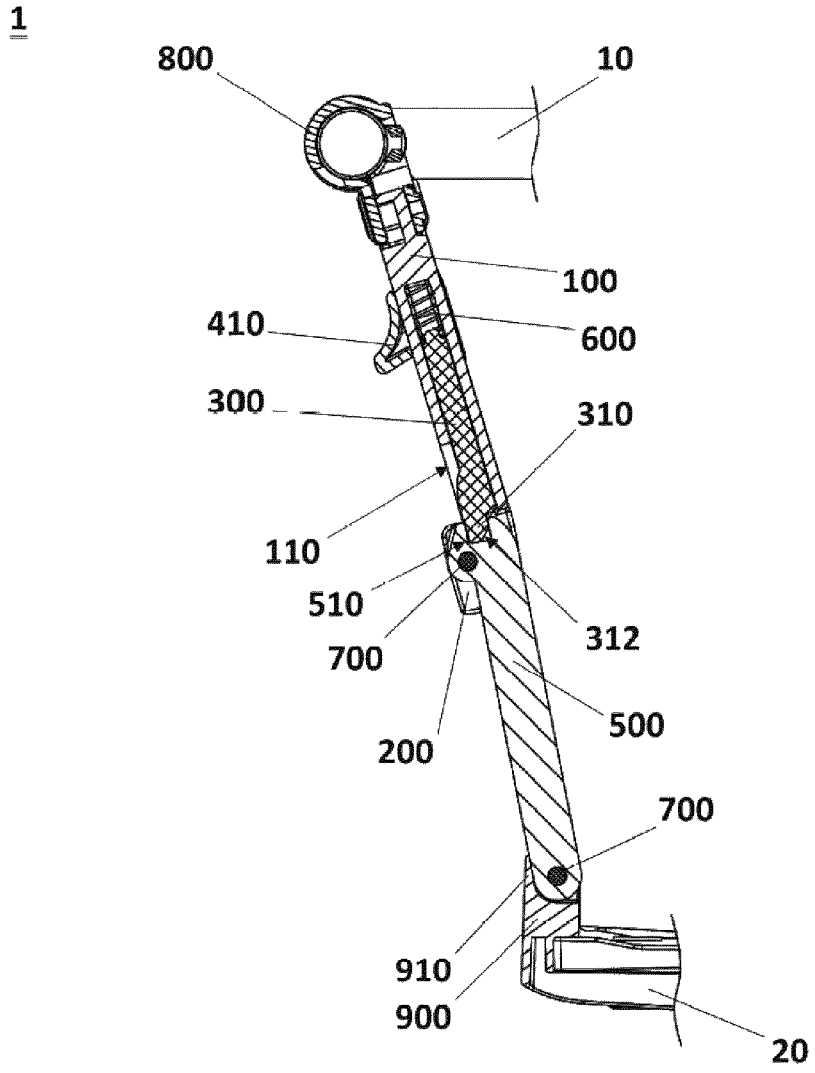
FIG. 5 is a partially enlarged schematic view of FIG. 4.
Figure 6:
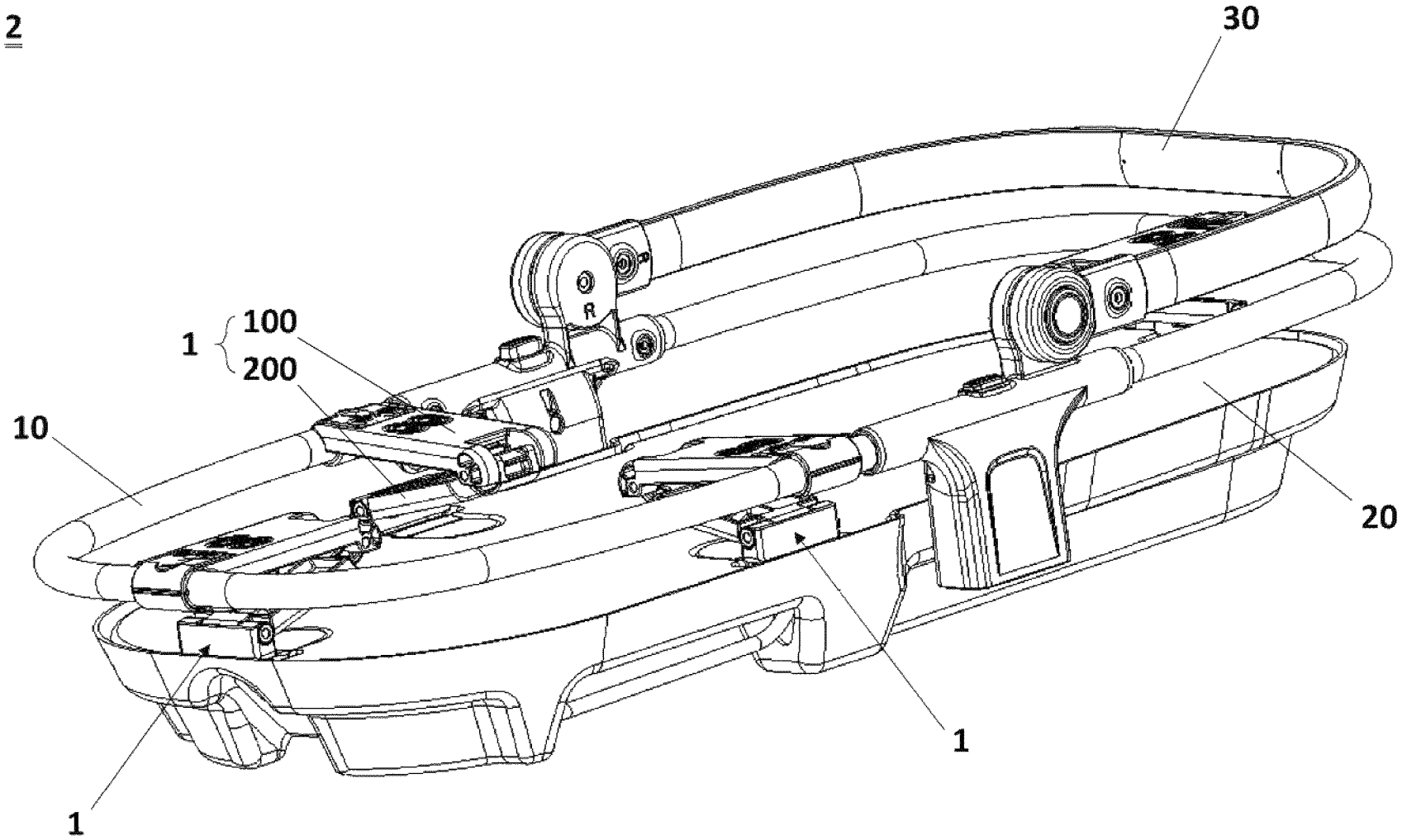
FIG. 6 is a perspective schematic view of the baby carrier of FIG. 1 in a folded state.

Referring to FIGS. 4 to 6, FIG. 4 is a schematic cross-sectional view of the baby carrier of FIG. 1, FIG. 5 is a partially enlarged schematic view of FIG. 4, and FIG. 6 is a perspective schematic view of the baby carrier of FIG. 1 in a folded state. As shown in FIG. 5, the first connecting element 100 is formed with an accommodating groove 110, wherein the accommodating groove 110 extends in a longitudinal direction of the first connecting element 100, the locking element 300 is slidably disposed in the accommodating groove 110, and the positioning element 500 is fixedly disposed on the second connecting element 200. Preferably, each of the folding mechanisms 1 further includes two limit elements 700, wherein the limit elements 700 are rivets or bolts, for example, and one of the limit elements 700 penetrates through an end of the first connecting element 100 and an end of the second connecting element 200, so that the first connecting element 100 and the second connecting element 200 are pivotally connected to each other through the limit element 700. The other of the limit elements 700 penetrates through the other end of the second connecting element 200 and the second auxiliary connector 900, so that the second connecting element 200 is pivotable relative to the second auxiliary connector 900. Thus, when the user operates the locking element 300 via the operating element 400 to slide upwards of the accommodating groove 110 in the longitudinal direction, the limit portion 310 is separated from the positioning portion 510 and the locking element 300 is no longer clamped on the positioning element 500, so that the first connecting element 100 and the second connecting element 200 is pivotable relative to each other through the limit element 700, and then the baby carrier 2 is switched into the folded state as shown in FIG. 6. Preferably, each of the folding mechanisms 1 further includes an elastic element 600, wherein the elastic element 600 is, for example, a spring and is used to return the locking element 300 to a position clamped with the positioning element 500. Specifically, the elastic element 600 is arranged in the accommodating groove 110 and connected to the first connecting element 100 and the locking element 300. When the user operates the locking element 300 via the operating element 400 to slide upwards, the elastic element 600 will be pressed and accumulate an elastic force. When the user releases the operating element 400 and the first connecting element 100 and the second connecting element 200 pivot to a position where the limit portion 310 corresponds to the positioning portion 510 again, the limit portion 310 will be pushed against by the elastic element 600 into the positioning portion 510, so that the baby carrier 2 is automatically locked in the unfolded state.

Furthermore, in order to reduce the wear between components of the locking element 300 during sliding, it is preferable that at least one of the limit portion 310 and the positioning portion 510 has a cambered surface, and in this embodiment, the limit portion 310 has a cambered surface 312. Thus, the locking element 300 can reduce the abrasion or collision with the positioning portion 510 by means of the buffer effect of the cambered surface 312, no matter whether it slides towards the upper end of the accommodating groove 110 through the operating element 400 or automatically resets when the baby carrier 2 changes from the folded state to the unfolded state, thereby facilitating to prolong the service life of the folding mechanisms 1.

In addition, the folding mechanism 1 of this embodiment also has an effect of limiting a displacement stroke of the operating element 400. In detail, as shown in FIG. 3, the first connecting element 100 is also formed with limit hole(s) 120, wherein the limit hole 120 is, for example, a long hole penetrating through a wall surface of the first connecting element 100, and has a longitudinal length (i.e., a length in the longitudinal direction) larger than that of the penetrating portion 420, and the penetrating portion 420 is slidably disposed in the limit hole 120. With this arrangement, when the user pushes against the operating element 400, the displacement stroke of the operating element 400 is limited to the longitudinal length of the limit hole 120, which can prevent the locking element 300 and the operating element 400 from excessively sliding.

In addition, in order to prevent the first connecting element 100 and the second connecting element 200 from pivoting towards outside of the baby carrier 2 to increase a volume of the baby carrier 2 when it is folded, the second auxiliary connector 900 of this embodiment includes a stopper 910 to limit a pivoting direction of the first connecting element 100 and the second connecting element 200. Specifically, the first part 10 and the second part 20 surround and form an accommodating space S for accommodating a baby, and the stopper 910 is arranged outside of the second connecting element 200 relative to the accommodating space S. When the baby carrier 2 is in the unfolded state, the stopper 910 abuts against an outer side of the lower end of the second connecting element 200, so that the first connecting element 100 and the second connecting element 200 cannot pivot outwardly from the accommodating space S, not only reducing the volume of the baby carrier 2 when it is folded, but also preventing the folding mechanisms 1 from protruding outwards and colliding with other objects and being damaged.

It is worth mentioning that, in this embodiment, the first connecting element 100 is pivotally connected to the first part 10, the second connecting element 200 is pivotally connected to the second part 20, and the locking element 300 and the positioning element 500 are respectively arranged on the first connecting element 100 and the second connecting element 200, however, the present disclosure is not limited to the above embodiment. In other possible embodiments, the first connecting element 100 may be pivotally connected to the second part 20, and the positioning element 500 may be arranged on the second connecting element pivotally connected to the first part 10, which can also achieve the effect of selectively clamping.

In addition, in this embodiment, the operating portion 410 protrudes relative to the surface of the first connecting element 100, but in other possible embodiments, the operating portion 410 may also have a concave structure relative to the surface of the first connecting element 100, so as to facilitate fingers of the user to put into and grasp. On the other hand, in this embodiment, the stopper 910 is arranged on the second auxiliary connector 900, but in other possible embodiments, the stopper may be arranged on the first auxiliary connector 800, or the stopper may be arranged on each of the first auxiliary connector 800 and the second auxiliary connector 900, which can also achieve the effect of preventing the first connecting element 100 and the second connecting element 200 from rotating outwardly from the accommodating space S.

Figure 7:
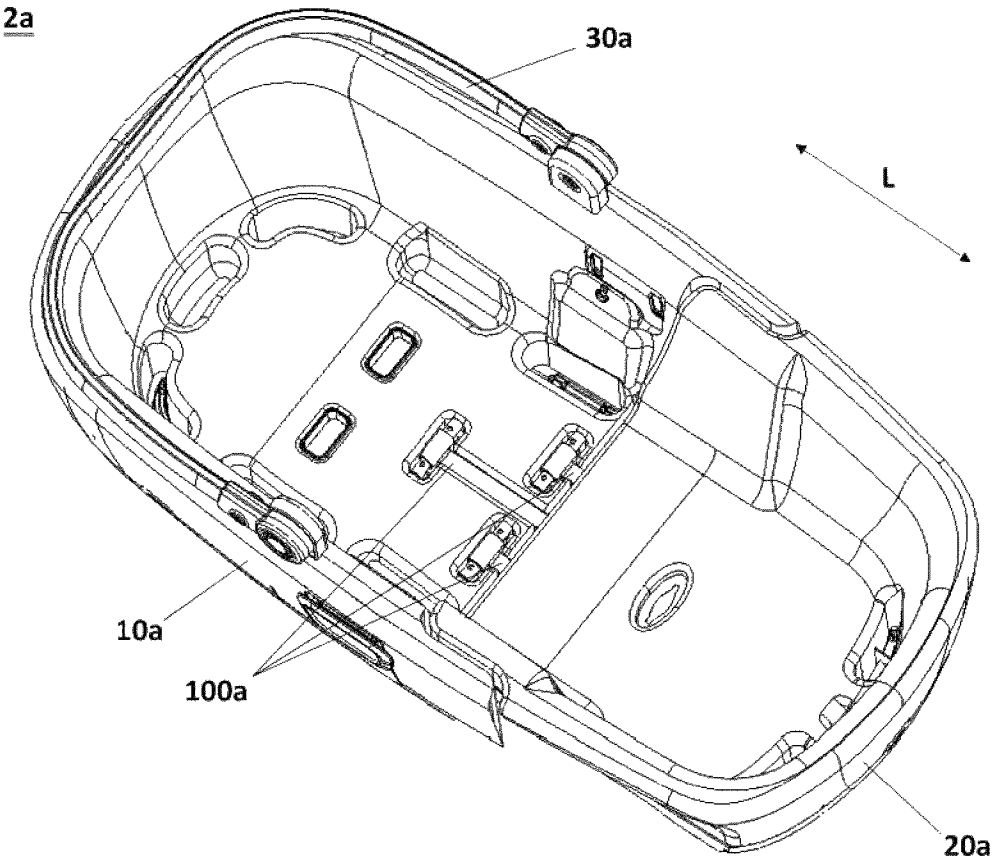
FIG. 7 is a perspective schematic view of a baby carrier in an unfolded state to which folding mechanisms according to a second embodiment of the present disclosure are applied.
Figure 8:
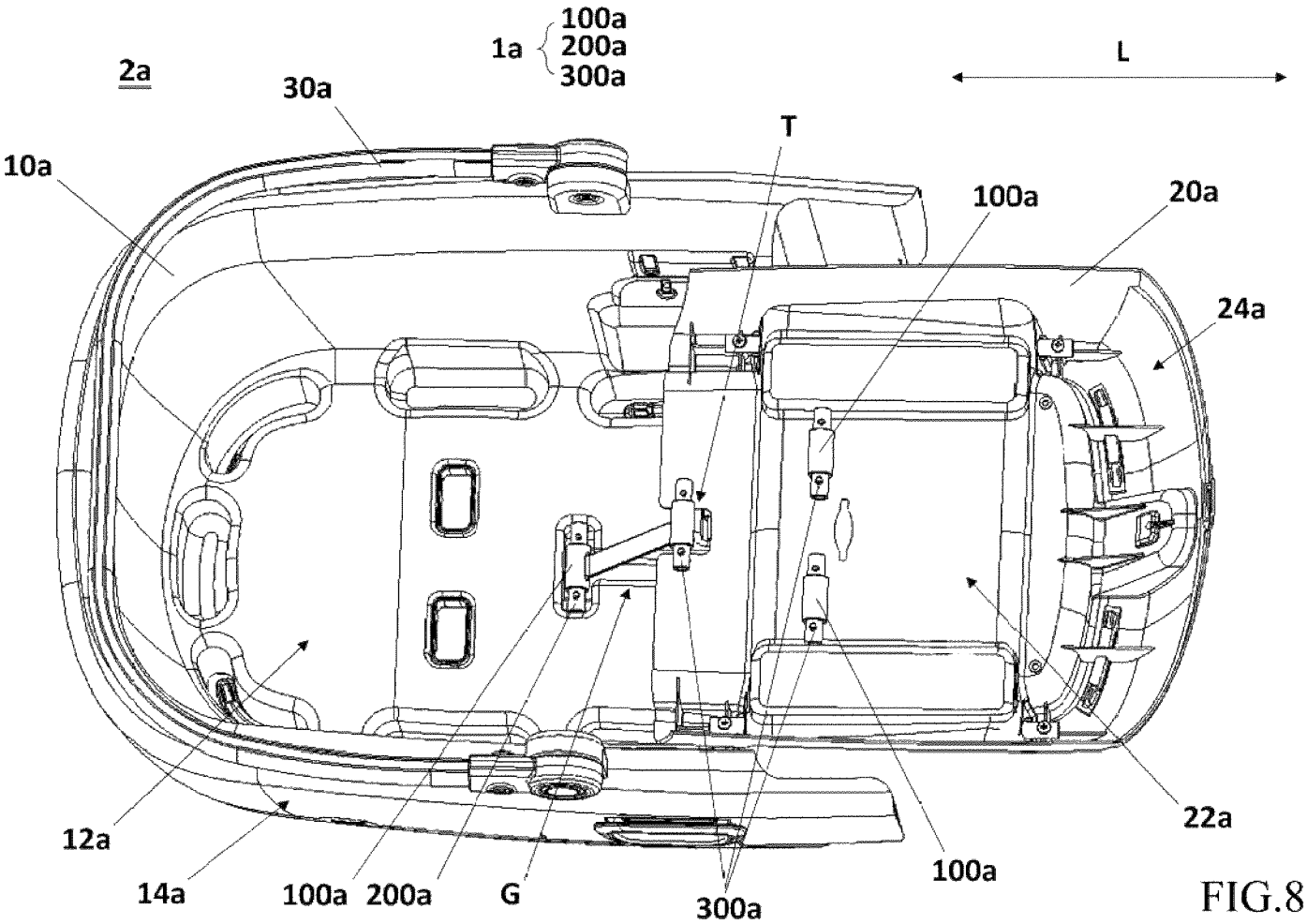
FIG. 8 is a perspective schematic view of the baby carrier of FIG. 7 during folding.
Figure 9:
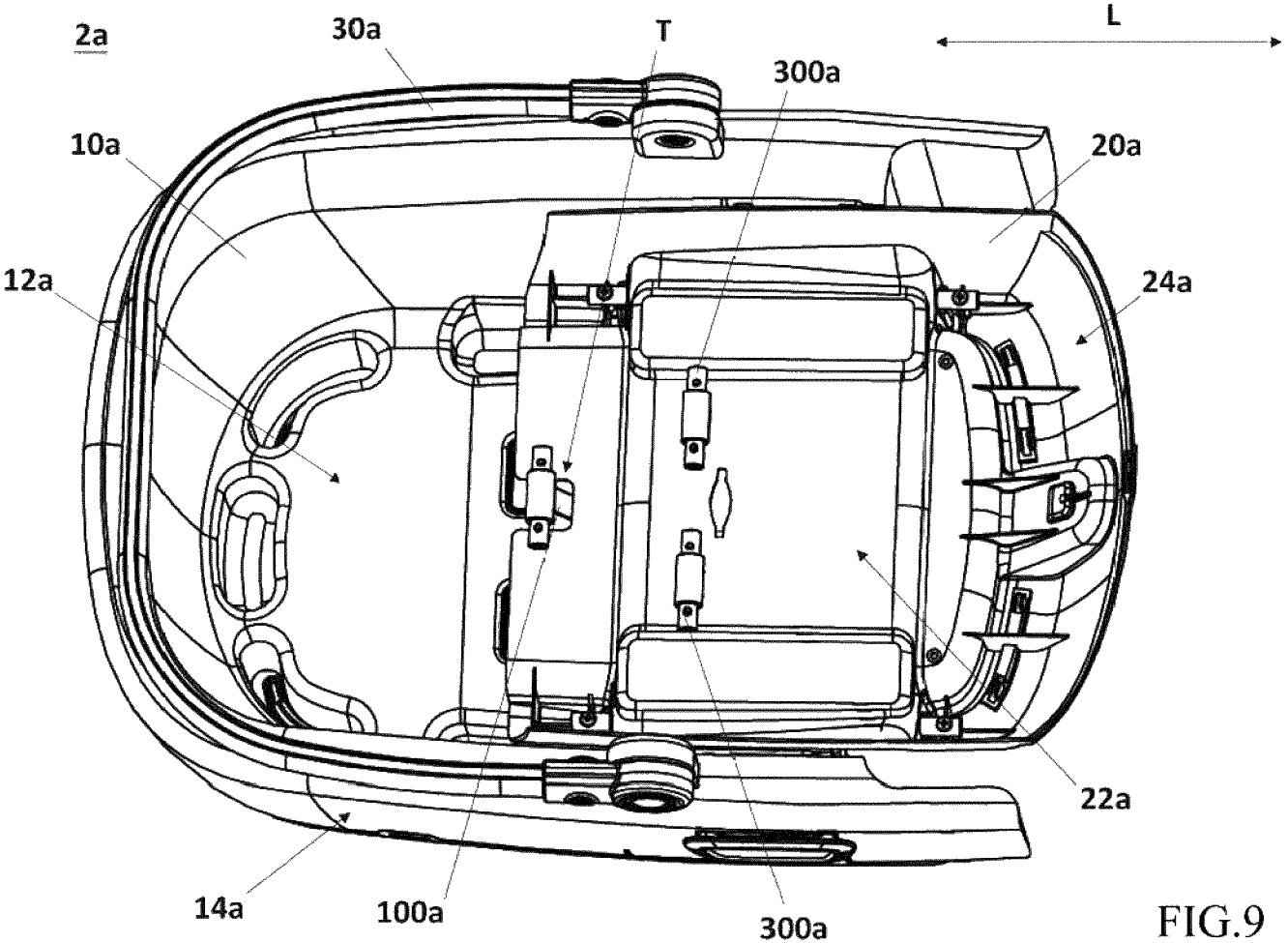
FIG. 9 is a perspective schematic view of the baby carrier of FIG. 7 in a folded state.

Referring to FIGS. 7 to 9, FIG. 7 is a perspective schematic view of the baby carrier in an unfolded state, FIG. 8 is a perspective schematic view of the baby carrier of FIG. 7 during folding, and FIG. 9 is a perspective schematic view of the baby carrier of FIG. 7 in a folded state. The folding mechanism 1*a* of this embodiment is applicable to a baby carrier 2*a*, which may also be a sleeping box or cradle and includes a first part 10*a* and a second part 20*a*, wherein the first part 10*a* is a front half of the sleeping box, the second part 20*a* is a rear half of the sleeping box, and the first part 10*a* and the second part 20*a* are arranged in a longitudinal direction L. On the other hand, the folding mechanism 1*a* includes a connecting element 100*a*, wherein the second part 20*a* is movably connected to the first part 10*a* through the connecting element 100*a*, and an extending direction of the connecting element 100*a* is parallel to the longitudinal direction L. Preferably, the baby carrier 2*a* further includes a handle 30*a*, wherein the handle 30*a* is connected to the first part 10*a*, and can be held by a user to facilitate carrying the baby carrier 2*a*.

Specifically, the connecting element 100*a* of this embodiment is, for example, a connecting rod and may be provided in plural, and the first part 10*a* and the second part 20*a* are pivotally connected to each other through the connecting element 100*a*. As shown in FIG. 8, the first part 10*a* includes a bottom plate 12*a* and a side wall 14*a*, the side wall 14*a* surrounds the bottom plate 12*a* and forms an opening at a position of the bottom plate 12*a* facing the second part 20*a*. The second part 20*a* further includes a bottom plate 22*a* and a side wall 24*a*, the side wall 24*a* surrounds the bottom plate 22*a* and forms an opening at a position of the bottom plate 22*a* facing the first part 10*a*, and the connecting element 100*a* is pivotally connected to the bottom plate 12*a* of the first part 10*a* and the bottom plate 22*a* of the second part 20*a*, respectively. Thus, the folding mechanism 1*a* is suitable for switching the baby carrier 2*a* between an unfolded state as shown in FIG. 7 and a folded state as shown in FIG. 9. When the baby carrier 2*a* is in the unfolded state, the opening of the first part 10*a* and the opening of the second part 20*a* are opposite to each other, and the bottom plate 22*a* of the second part 20*a* abuts against and is coplanar with the bottom plate 12*a* of the first part 10*a*. When the user finishes using the baby carrier 2*a*, the second part 20*a* may be screwed into the space surrounded by the side wall 14*a* of the first part 10*a* through the connecting element 100*a*, and at this time, the bottom plate 22*a* and the side wall 24*a* of the second part 20*a* will be superposed on the bottom plate 12*a* and the side wall 14*a* of the first part 10*a*, respectively, forming a state shown in FIG. 9.

Furthermore, in order for the connecting element 100*a* to smoothly drive the second part 20*a* to pivot relative to the first part 10*a*, the bottom plate 12*a* of this embodiment is provided with accommodating grooves G. The number of the accommodating grooves G corresponds to the number of connecting elements 100*a* and the accommodating grooves G are recessed relative to an upper surface of the bottom plate 12*a*. The bottom plate 22*a* is provided with through grooves T, the number of through grooves T also corresponds to the number of connecting elements 100*a*, and the through grooves T communicates an upper surface with a lower surface of the bottom plate 22*a*. The connecting element 100*a* penetrates through the accommodating groove G and the through groove T. In other words, the connecting element 100*a* penetrates through the bottom plate 22*a* through the through groove T, so that the connecting element 100*a* may rotate relative to the bottom plate 22*a* in the longitudinal direction L and a thickness direction of the bottom plate 22*a* during pivoting of the second part 20*a* relative to the first part 10*a*. When the baby carrier 2*a* is in the unfolded state, the connecting element 100*a* may also be received in the accommodating groove G, and thus will not protrude from the bottom plate 12*a* and the bottom plate 22*a*, which causes discomfort for the baby to lie down.

Preferably, the folding mechanism 1*a* further includes a first limit element 200*a* and a second limit element 300*a*, wherein the first limit element 200*a* and the second limit element 300*a* are, for example, bolts and are fixedly disposed on the bottom plate 12*a* and the bottom plate 22*a* respectively, and the connecting element 100*a* has sleeve-like structures at its head and tail ends, and the connecting element 100*a* is sleeved on the first limit element 200*a* and the second limit element 300*a* through the above-mentioned sleeve structures. With this arrangement, pivoting of the second part 20*a* relative to the first part 10*a* can be realized by rotating of the connecting element 100*a* relative to the first limit element 200*a* and the second limit element 300*a*, thereby reducing the abrasion between components and the bottom plates 12*a* and 22*a*. Of course, in other possible embodiments, the first limit element 200*a* and the second limit element 300*a* may be pivoted or clamped to the bottom plate 12*a* and the bottom plate 22*a*, respectively, and the connecting element 100*a* is fixed relative to the first limit element 200*a* and the second limit element 300*a*, or even the connecting element 100*a* is directly pivotally connected to the bottom plate 12*a* and the bottom plate 22*a*, which is not limited by the present disclosure.

Figure 10:
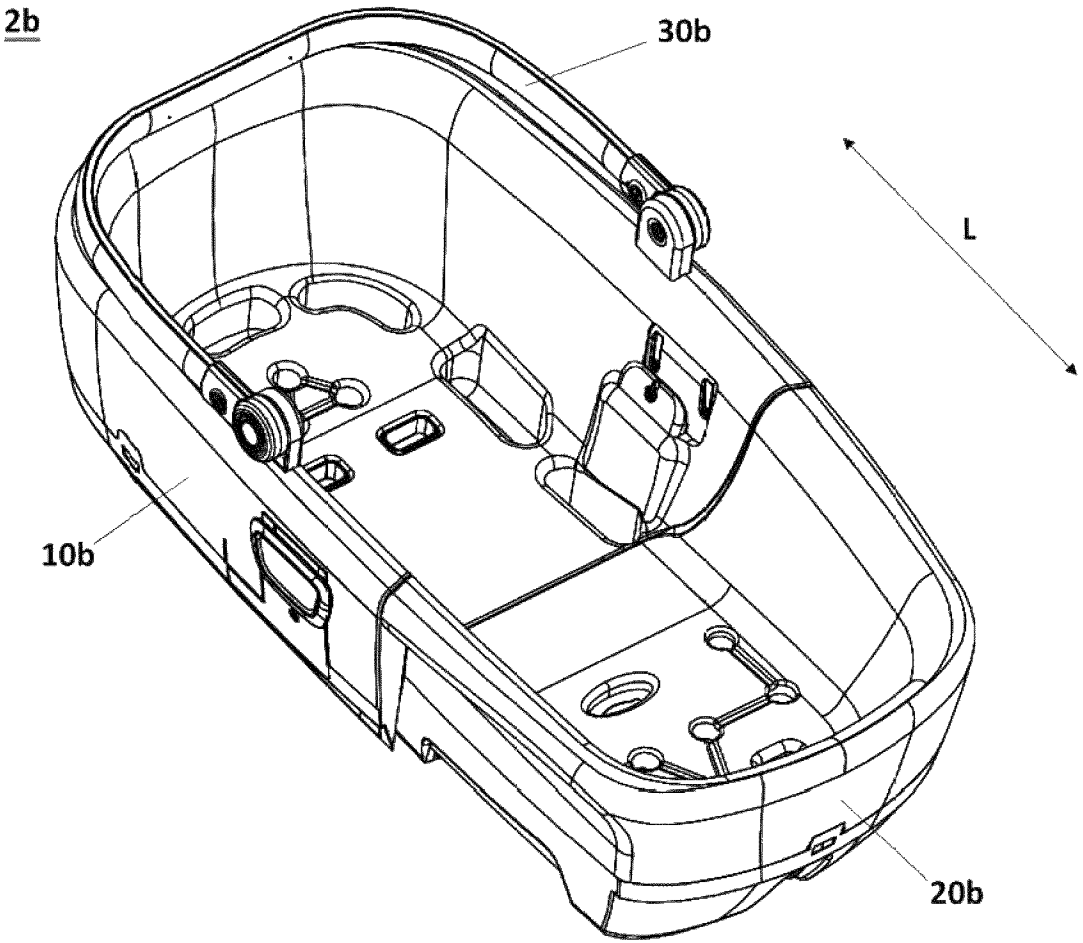
FIG. 10 is a perspective schematic view of a baby carrier in an unfolded state to which folding mechanisms according to a third embodiment of the present disclosure are applied.
Figure 11:
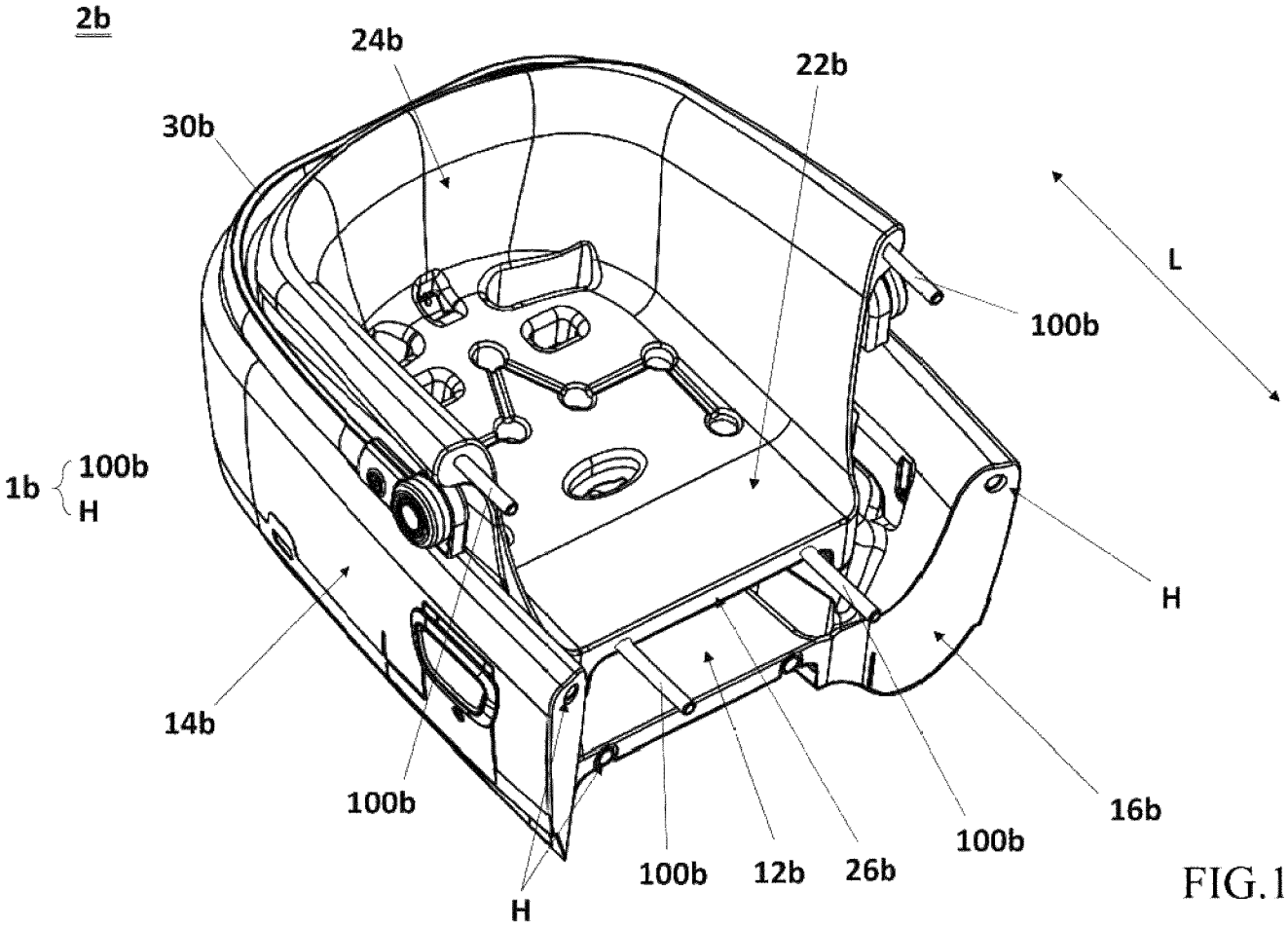
FIG. 11 is a perspective schematic view of the baby carrier of FIG. 10 in a folded state.

Referring to FIGS. 10 and 11, FIG. 10 is a perspective schematic view of a baby carrier in an unfolded state to which folding mechanisms according to a third embodiment of the present disclosure are applied, and FIG. 11 is a perspective schematic view of the baby carrier of FIG. 10 in a folded state. The folding mechanism 1*b* of this embodiment is suitable for the baby carrier 2*b* and similar to the folding mechanism 1*a*. The main difference between the folding mechanism 1*b* and the folding mechanism 1*a* is that, the folding mechanism 1*b* includes a connecting element 100*b* and a connecting hole H, and the first part 10*b* and the second part 20*b* are detachably connected to each other through the connecting element 100*b* and the connecting hole H.

Specifically, as shown in FIG. 11, the first part 10*b* includes an end face 16*b* in addition to the bottom plate 12*b* and the side wall 14*b*, and the end face 16*b* is formed at a side of the bottom plate 12*b* and the side wall 14*b*. Similarly, the second part 20*b* includes an end face 26*b* in addition to the bottom plate 22*b* and the side wall 24*b*, and the end face

26*b* is formed at a side of the bottom plate 22*b* and the side wall 24*b*. In this embodiment, the connecting element 100*b* is fixedly disposed on the end face 26*b* of the second part 20*b* and protrudes relative to the end face 26*b*, while the connecting hole H is formed on the end face 16*b* of the first part 10*b*, and the number and position of the connecting hole H correspond to those of the connecting element 100*b*. With this arrangement, when the user finishes using the baby carrier 2*b*, the second part 20*b* may be pulled out of the connecting hole H of the first part 10*b* together with the connecting element 100*b*, and the second part 20*b* is stacked on the first part 10*b*, so that the user can carry the baby carrier 2*b* with reduced longitudinal length at one time only by the handle 30*b* connected to the first part 10*b*, thus improving the convenience of using the baby carrier 2*b*.

In addition, a length of the second part 20*b* in the longitudinal direction L of this embodiment is less than or equal to a length of the first part 10*b* in the longitudinal direction L, and a length of the connecting element 100*b* protruding relative to the end face 26*b* is less than a length difference between the first part 10*b* and the second part 20*b* in the longitudinal direction L. With this arrangement, when the baby carrier 2*b* is in the folded state, a part of the connecting element 100*b* protruding relative to the end face 26*b* will not exceed the end face 16*b*, preventing the connecting element 100*b* from being damaged due to collision with external members.

It is worth mentioning that in this embodiment, the connecting element 100*b* is fixedly disposed on the end face 26*b* and the connecting hole H is formed on the end face 16*b*, however, the connecting element 100*b* may also be fixedly disposed on the end face 16*b* and the connecting hole H is formed on the end face 26*b*, which can also achieve the effect of detachably connecting the first part 10*b* and the second part 20*b* to each other.

Figure 12:
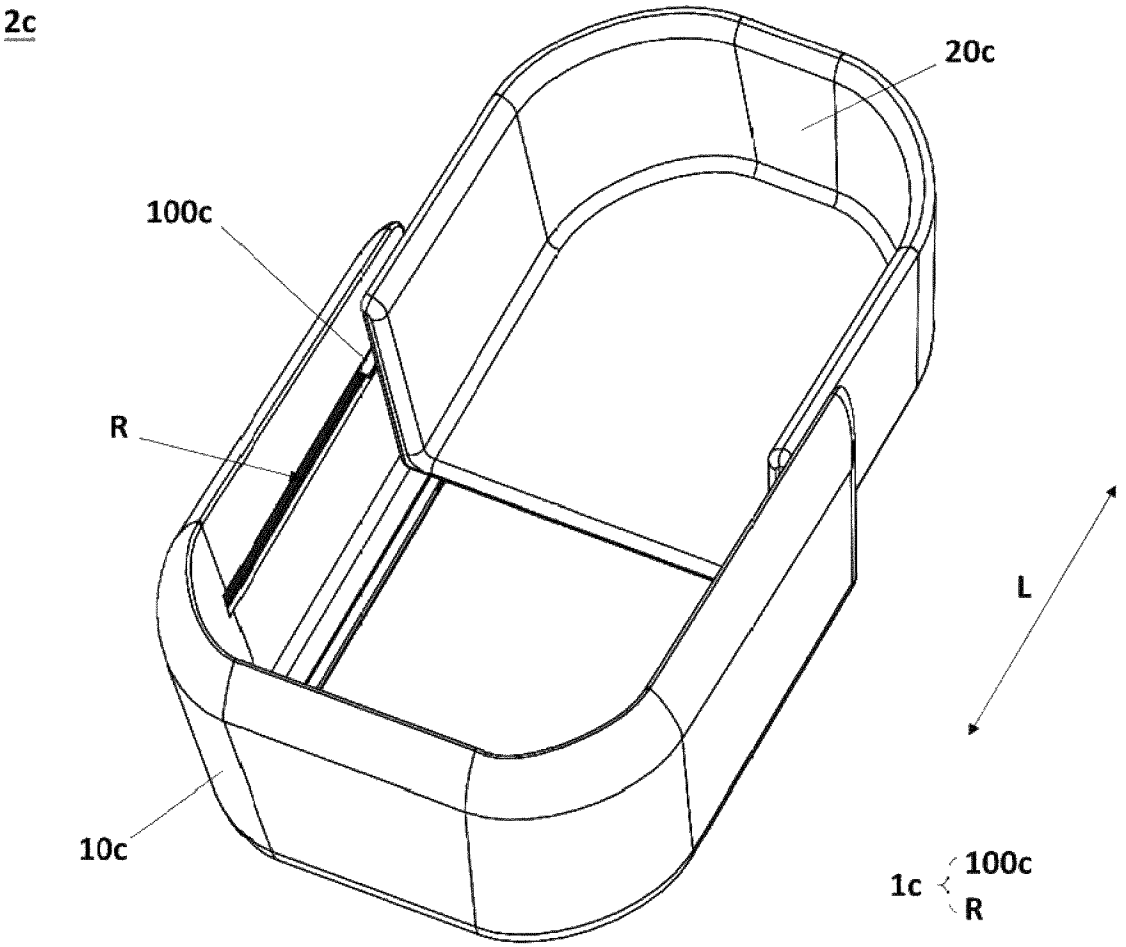
FIG. 12 is a perspective schematic view of a baby carrier in an unfolded state to which folding mechanisms according to a fourth embodiment of the present disclosure are applied.

Referring to FIG. 12, FIG. 12 is a perspective schematic view of a baby carrier in an unfolded state to which folding mechanisms according to a fourth embodiment of the present disclosure are applied. The folding mechanism 1*c* of this embodiment is suitable for the baby carrier 2*c* and similar to the folding mechanism 1*b*. The main difference between the folding mechanism 1*c* and the folding mechanism 1*b* is that, the folding mechanism 1*c* includes a connecting element 100*c* and a sliding rail R, and the first part 10*c* and the second part 20*c* are slidably connected with each other through the connecting element 100*c* and the sliding rail R.

Figure 13:
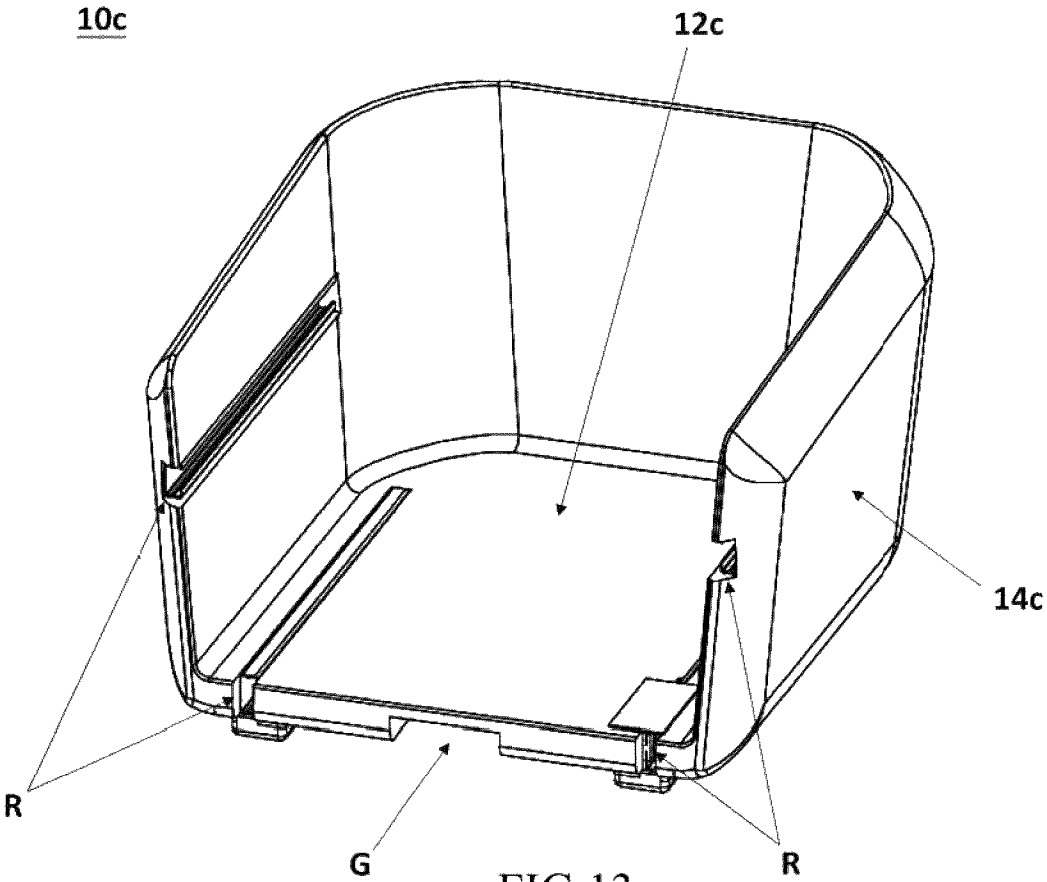
FIG. 13 is a perspective schematic view of a first part of FIG. 12.
Figure 14:
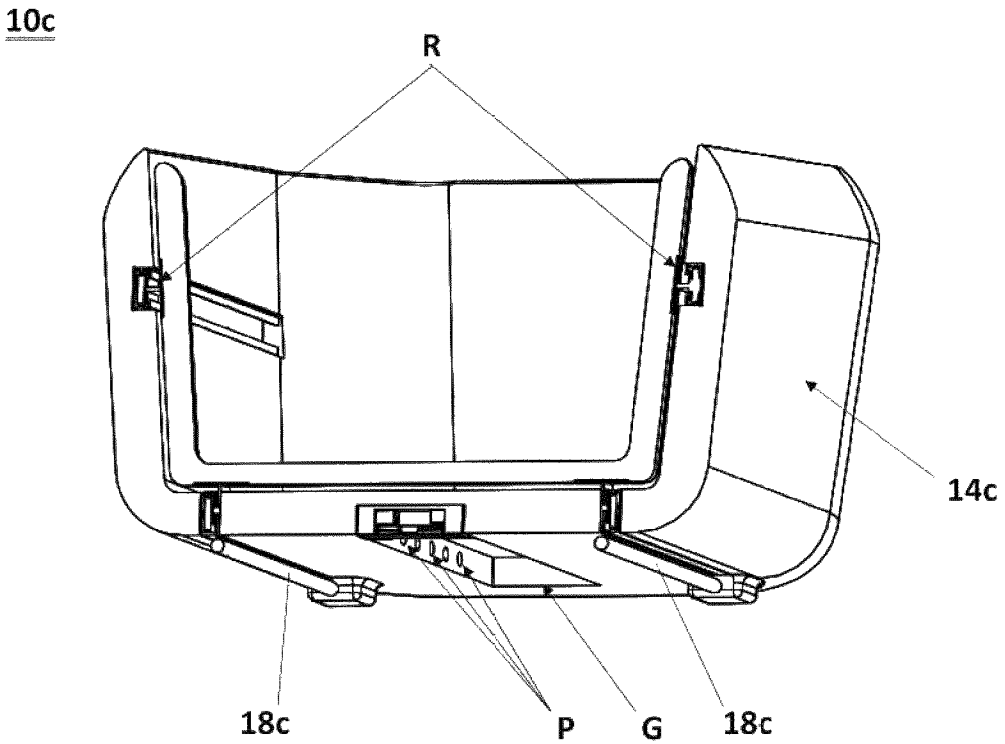
FIG. 14 is a perspective schematic view of the first part of FIG. 13 from another perspective.
Figure 15:
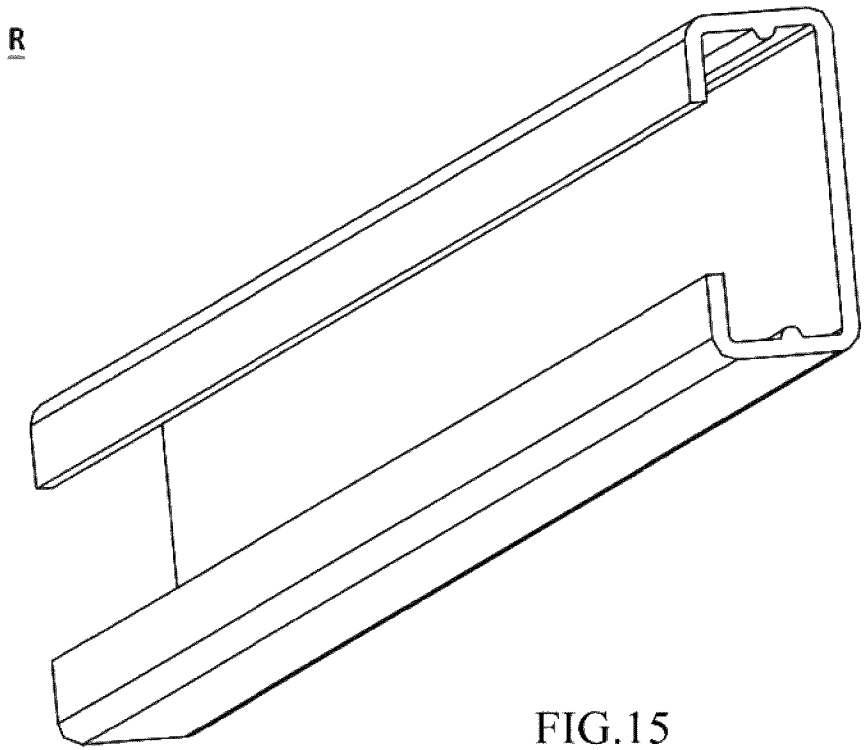
FIG. 15 is a perspective schematic view of a sliding rail of FIG. 14.
Figure 16:
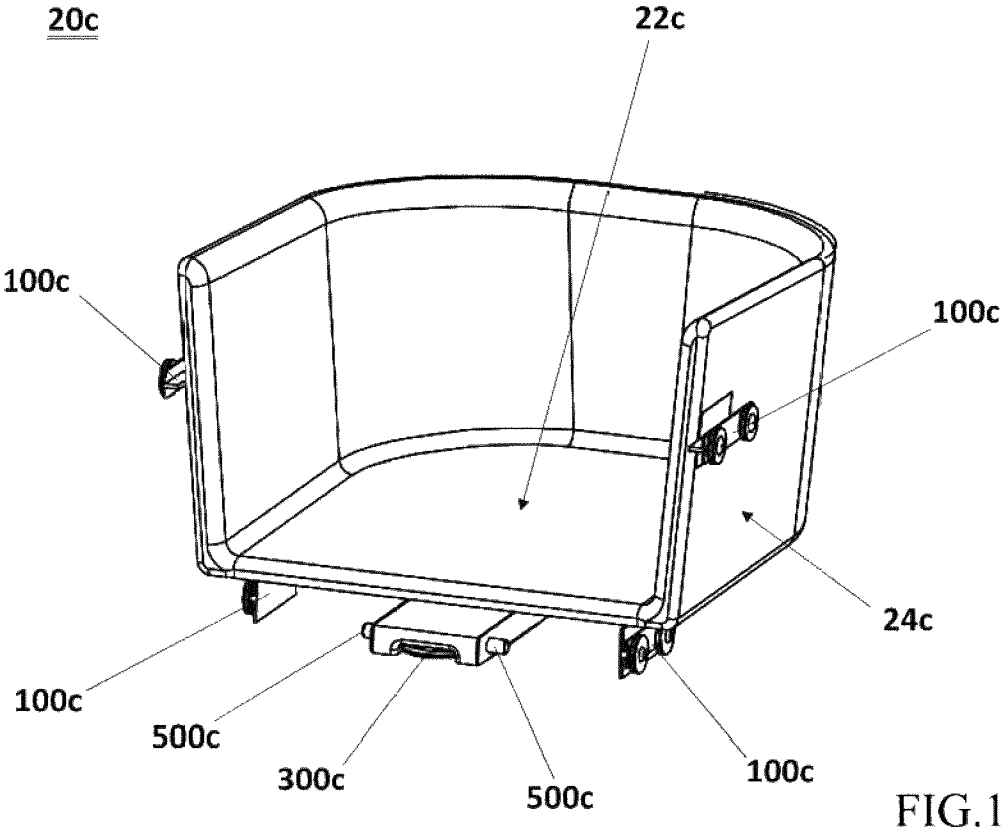
FIG. 16 is a perspective schematic view of a second part of FIG. 12.
Figure 17:
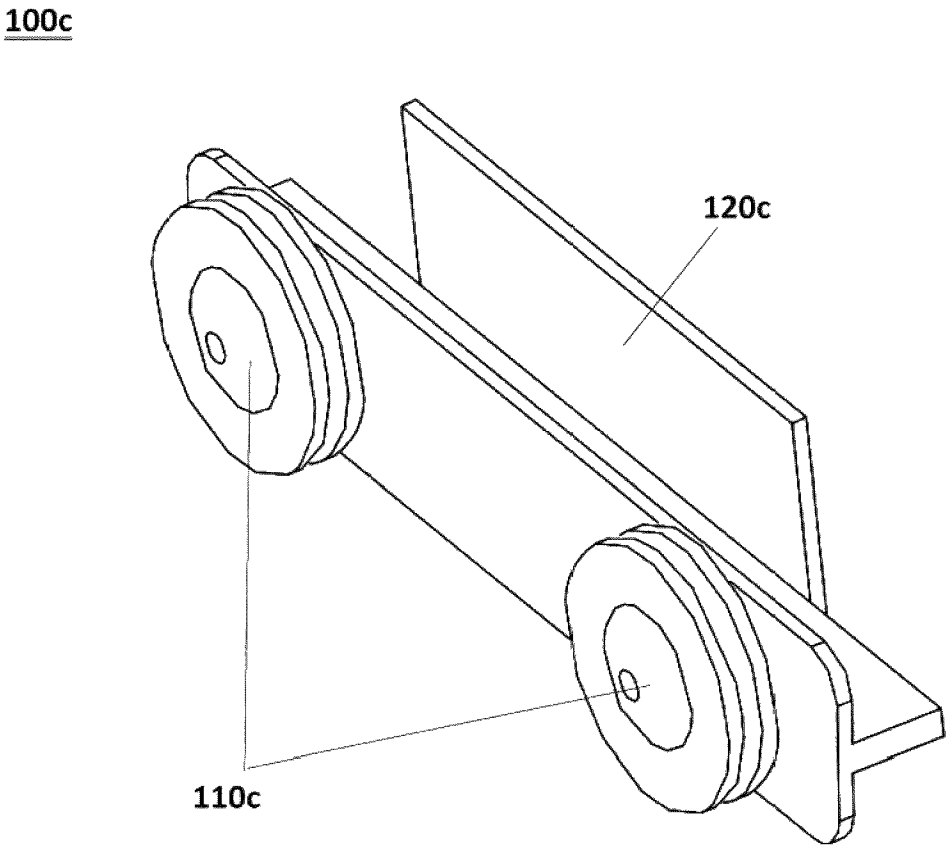
FIG. 17 is a perspective schematic view of a connecting element of FIG. 16.

Referring to FIGS. 13 to 17, FIG. 13 is a perspective schematic view of a first part of FIG. 12, FIG. 14 is a perspective schematic view of the first part of FIG. 13 from another perspective, FIG. 15 is a perspective schematic view of the sliding rail of FIG. 14, FIG. 16 is a perspective schematic view of the second part of FIG. 12, and FIG. 17 is a perspective schematic view of the connecting element of FIG. 16. In detail, the connecting element 100*c* is arranged outside of at least one of the bottom plate 22*c* and the side wall 24*c* of the second part 20*c*. In this embodiment, one connecting element 100*c* is arranged on an outer side of each of the bottom plate 22*c* and the side wall 24*c*, and the connecting element 100*c* includes a sliding portion 110*c* and a fixing portion 120*c*, wherein the sliding portion 110*c* is, for example, a roller or rollers and is pivotally connected to the fixing portion 120*c*, and the connecting element 100*c* is fixedly disposed outside of the bottom plate 22*c* and the side wall 24*c* by the fixing portion 120*c*, however, it is not limited by the above-mentioned embodiment in the present disclosure. In other possible embodiments, the sliding portion 110*c* may be directly and integrally formed on the bottom plate 22*c* and the side wall 24*c*. On the other hand, sliding rails R are arranged on the bottom plate 12*c* and the side wall 14*c* of the first part 10*c*, the number and position of which correspond to those of the connecting elements 100*c*, and the sliding portion 110*c* is slidably disposed on the sliding rail R. Thus, when the user finishes using the baby carrier 2*c*, the second part 20*c* may be received inside the first part 10*c* through the connecting elements 100*c* and the sliding rails R, thereby reducing a volume occupied by the baby carrier 2*c* in the folded state. It is worth mentioning that, in other possible embodiments, the connecting elements 100*c* may be arranged inside the first part 10*c* and the sliding rails R may be arranged outside the second part 20*c*, and the cooperation between the connecting element 100*c* and the sliding rail R may be replaced by an equivalent combination such as a slider and a sliding groove, which is not limited by the present disclosure. Preferably, the first part 10*c* is further provided with a guide post 18*c*, which can assist the connecting element 100*c* to be slidably disposed on the sliding rail R more stably.

Figure 18:
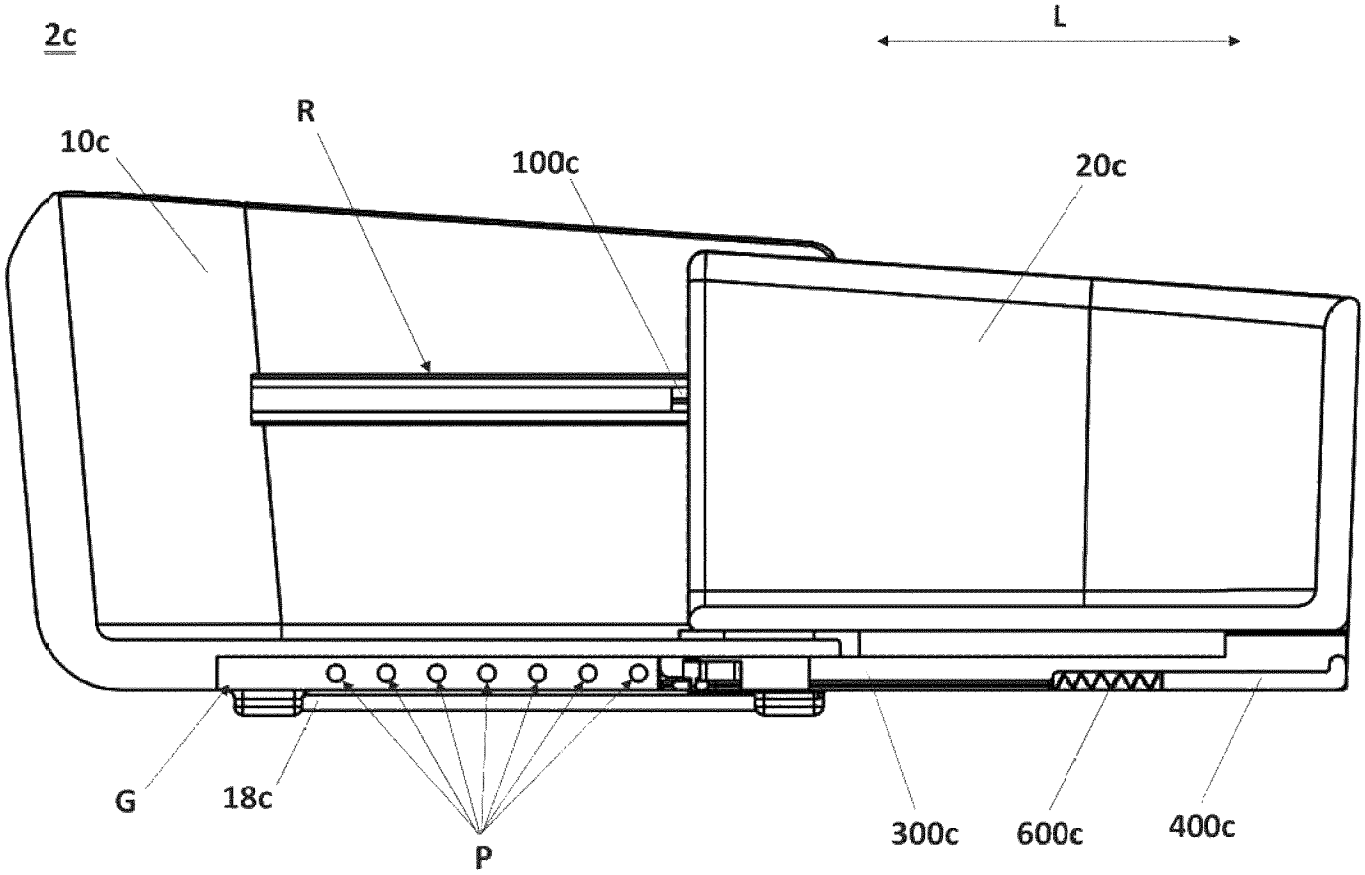
FIG. 18 is a schematic cross-sectional view of the baby carrier of FIG. 12.
Figure 19:
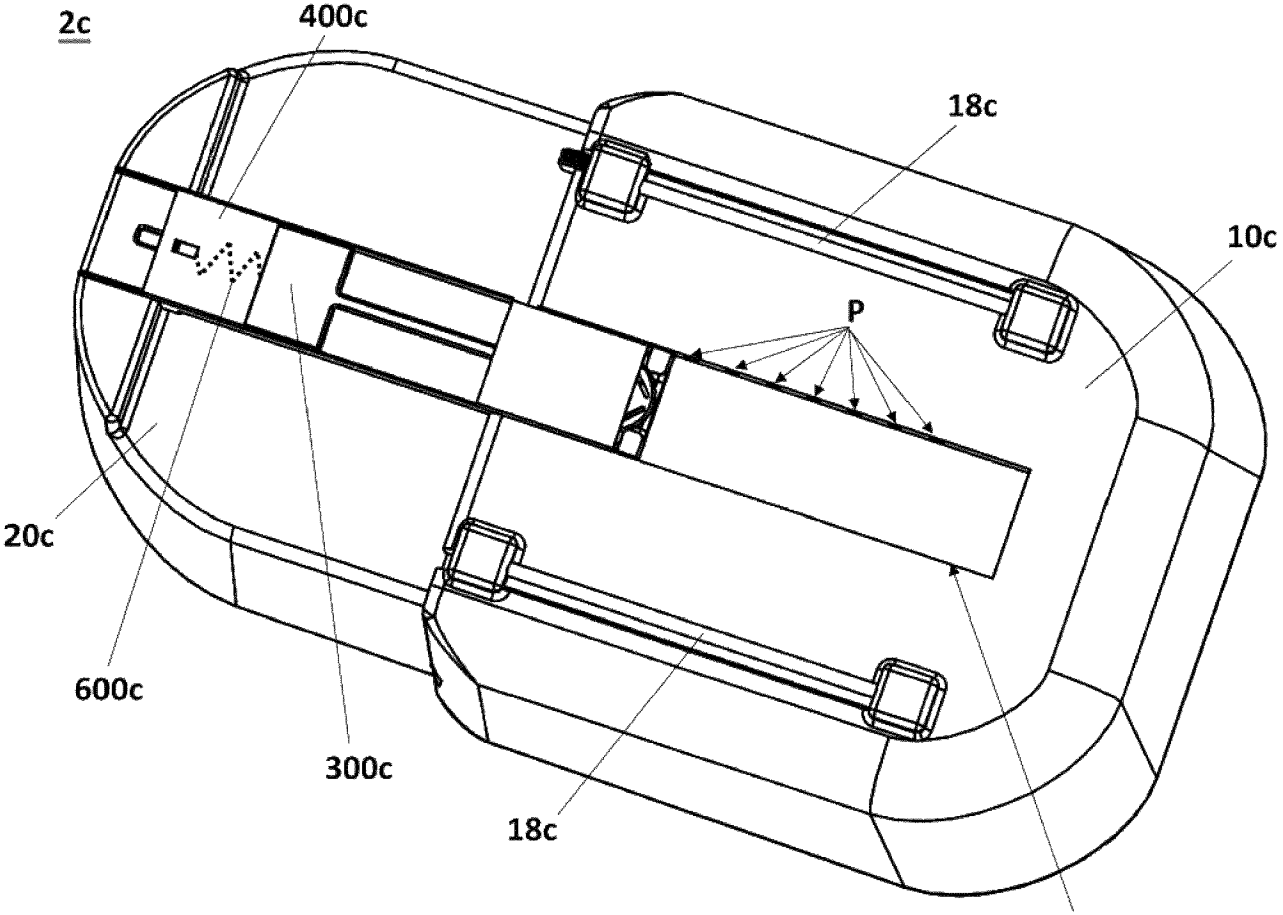
FIG. 19 is a schematic bottom view of the baby carrier of FIG. 12.
Figure 20:
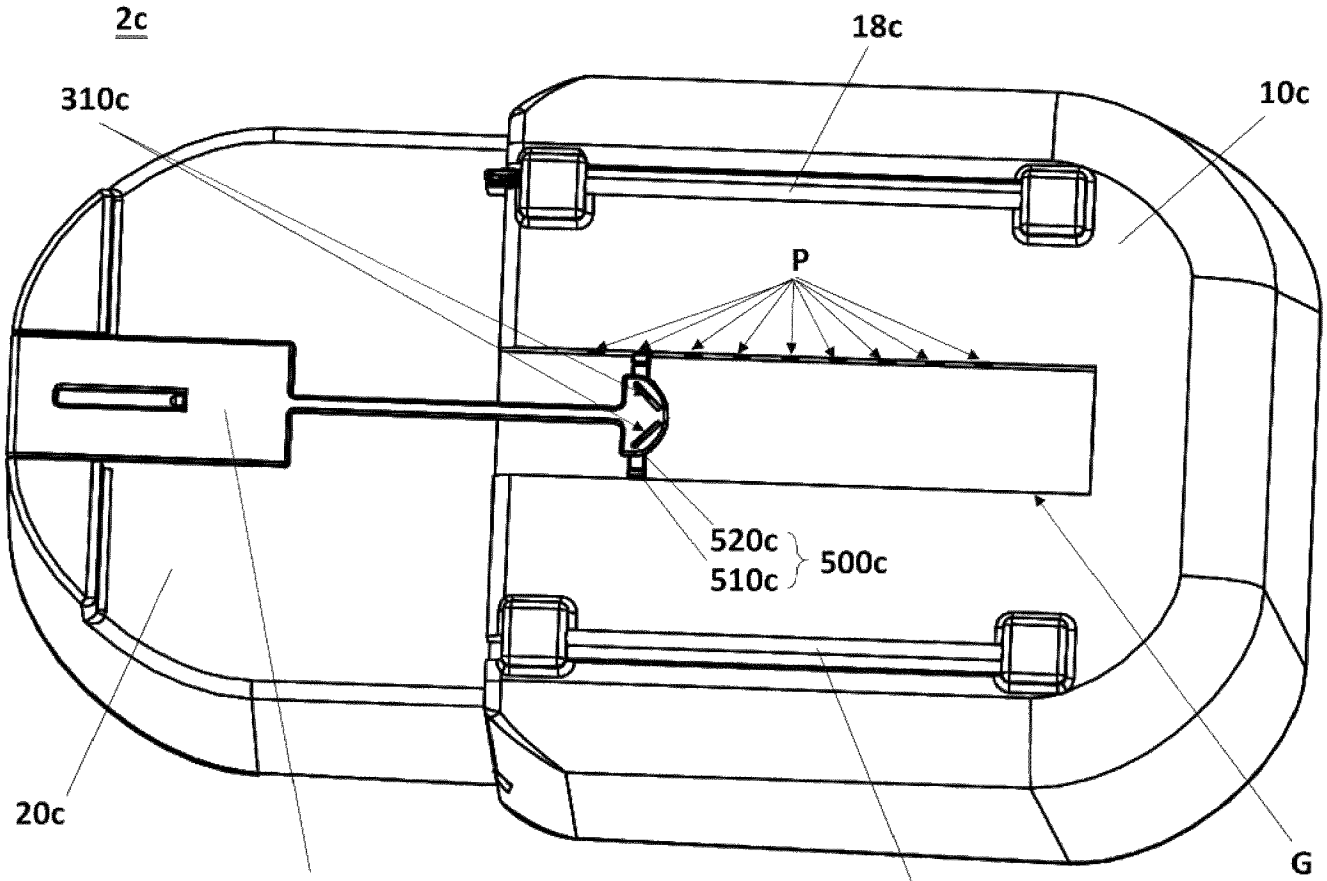
FIG. 20 is a schematic bottom view of the baby carrier of FIG. 19 with a cover removed.

In addition that the first part 10*c* and the second part 20*c* may slide freely, the folding structure 1*c* of this embodiment further includes functions of locking and unlocking the second part 20*c* at a specific position relative to the first part 10*c*. Referring to FIGS. 18 to 20, FIG. 18 is a cross-sectional schematic view of the baby carrier of FIG. 12, FIG. 19 is a schematic bottom view of the baby carrier of FIG. 12, and FIG. 20 is a schematic bottom view of the baby carrier of FIG. 19 with a cover removed. Specifically, the first part 10*c* is formed with a plurality of locking holes P, and the folding mechanism 1*c* further includes an operating element 300*c*, a cover 400*c* and at least one locking element 500*c*, wherein the operating element 300*c* is connected to the cover 400*c* and is formed with at least one limit groove 310*c*, and two limit grooves 310*c* are provided in this embodiment. The cover 400*c* is arranged on the second part 20*c* for the user to position the operating element 300*c*. In this embodiment, two locking elements 500*c* are provided, and each of the locking elements 500*c* includes a locking portion 510*c* and a limit portion 520*c*, and the limit portion 520*c* is slidably disposed in the limit groove 310*c*. When the locking element 500 slides relative to the first part 10*c* and aligns with the locking hole P, the locking portion 510*c* will be clamped to the locking hole P, and the second part 20*c* will be fixed relative to the first part 10*c* through the operating element 300*c*, achieving the effect of locking the second part 20*c* at a specific position.

Furthermore, as shown in FIGS. 19 and 20, the folding mechanism 1*c* further includes an elastic element 600*c*, wherein the elastic element 600*c* is, for example, a spring and is arranged between the operating element 300*c* and the locking element 500*c*, and in this embodiment, it is also arranged between the operating element 300*c* and the cover 400*c*. Preferably, an extending direction of the locking element 500*c* is inclined relative to the longitudinal direction L. In this embodiment, the extending direction of the locking element 500*c* is perpendicular to the longitudinal direction L, and an extending direction of the limit groove 310*c* is inclined relative to the longitudinal direction L and the extending direction of the locking element 500*c*. When the user wishes to release the locked state of the first part 10*c* and the second part 20*c*, the operating element 300*c* may be pulled to overcome an elastic force of the elastic element 600*c* and enable the operating element 300*c* to slide relative to the first part 10*c*. At this time, the limit portion 520*c* of the locking element 500*c* will slide along the limit groove 310*c* thereby moving from an outer end to an inner end of the limit groove 310*c*, so that the locking portion 510*c* is separated from the locking hole P to release the locked state of the first part 10*c* and the second part 20*c*. When the user releases his/her hand, the operating element 300*c* or the locking element 500*c* will be subjected to a restoring force of the elastic element 600*c*, so that the locking element 500*c* will be clamped into the nearest locking hole P again, and the first part 10*c* and the second part 20*c* will be locked with each other again.

Preferably, as shown in FIGS. 18 to 20, the operating element 300*c* is arranged outside of the bottom plate 22*c* of the second part 20*c*, the bottom plate 12*c* of the first part 10*c* is formed with an accommodating groove G, the locking holes P are disposed on a side of the accommodating groove G, and the operating element 300*c* and the locking element 500*c* are slidably disposed in the accommodating groove G. With this arrangement, during the operation, components such as the operating element 300*c*, the cover 400*c* and the locking element 500*c* will not affect the baby lying in the baby carrier 2*c*, and will not additionally increase the thickness of the bottom of the baby carrier 2*c*. It is worth mentioning that in other possible embodiments, positions of the accommodating groove G and the operating element 300*c* may also be reversed, which will not be limited by the present disclosure.

Figure 21:
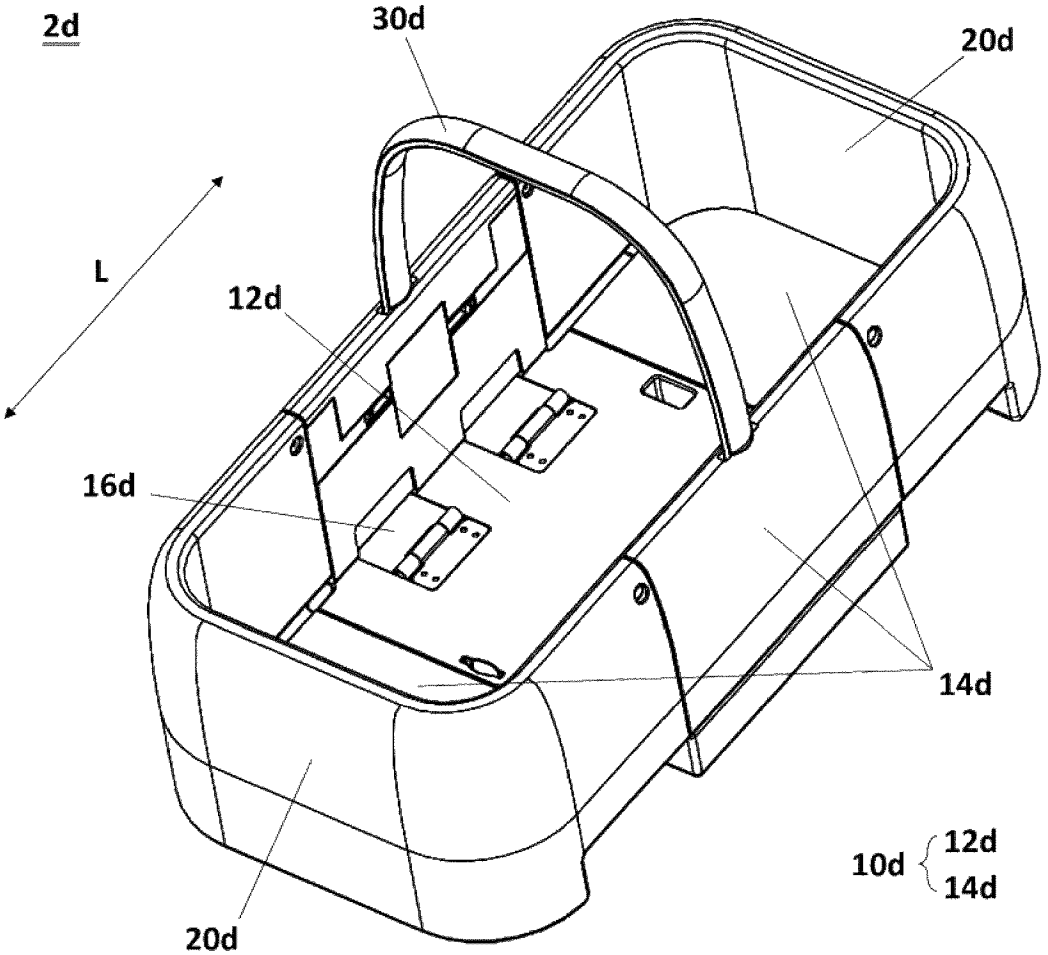
FIG. 21 is a perspective schematic view of a baby carrier in an unfolded state to which folding mechanisms according to a fifth embodiment of the present disclosure are applied.
Figure 22:
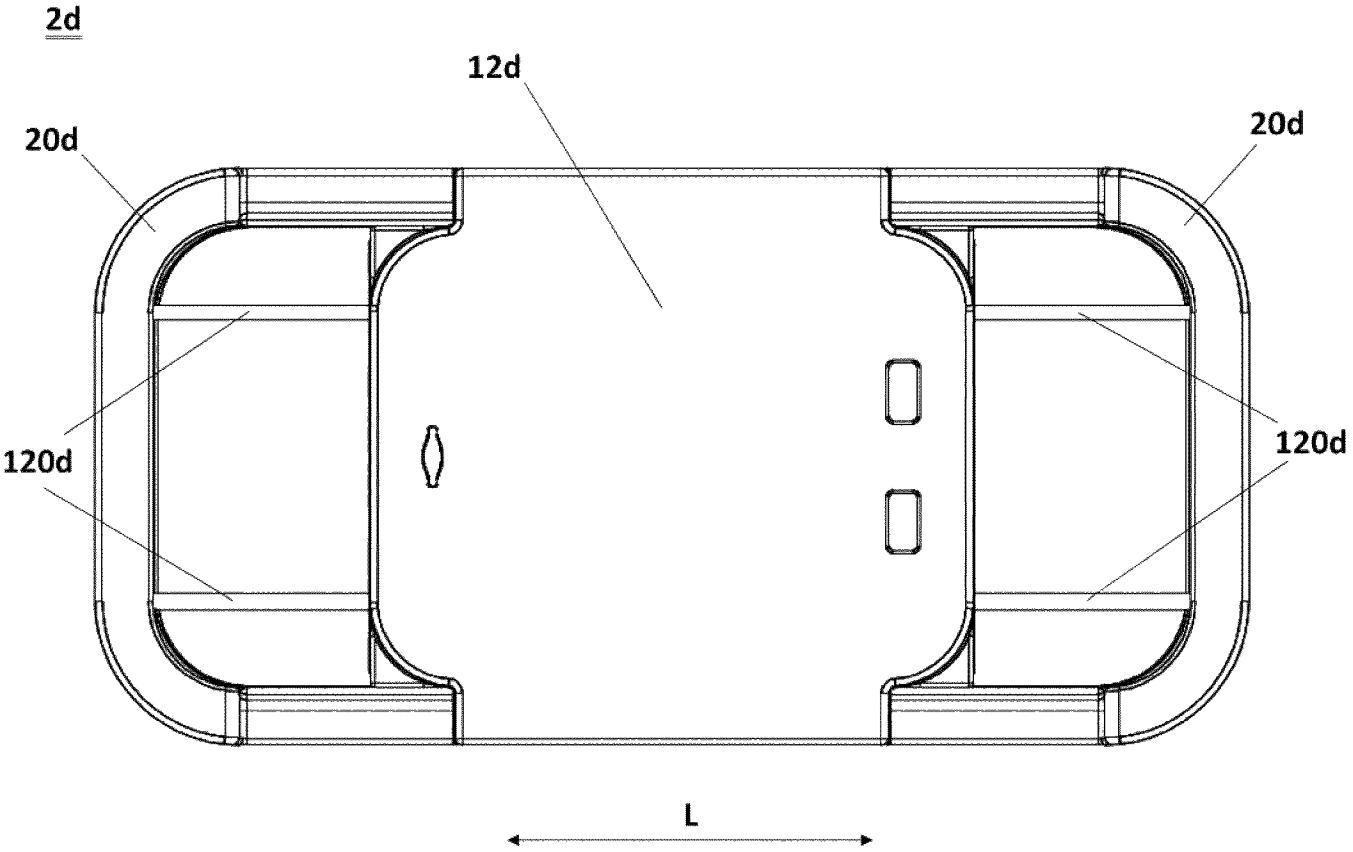
FIG. 22 is a schematic bottom view of the baby carrier of FIG. 21.
Figure 23:
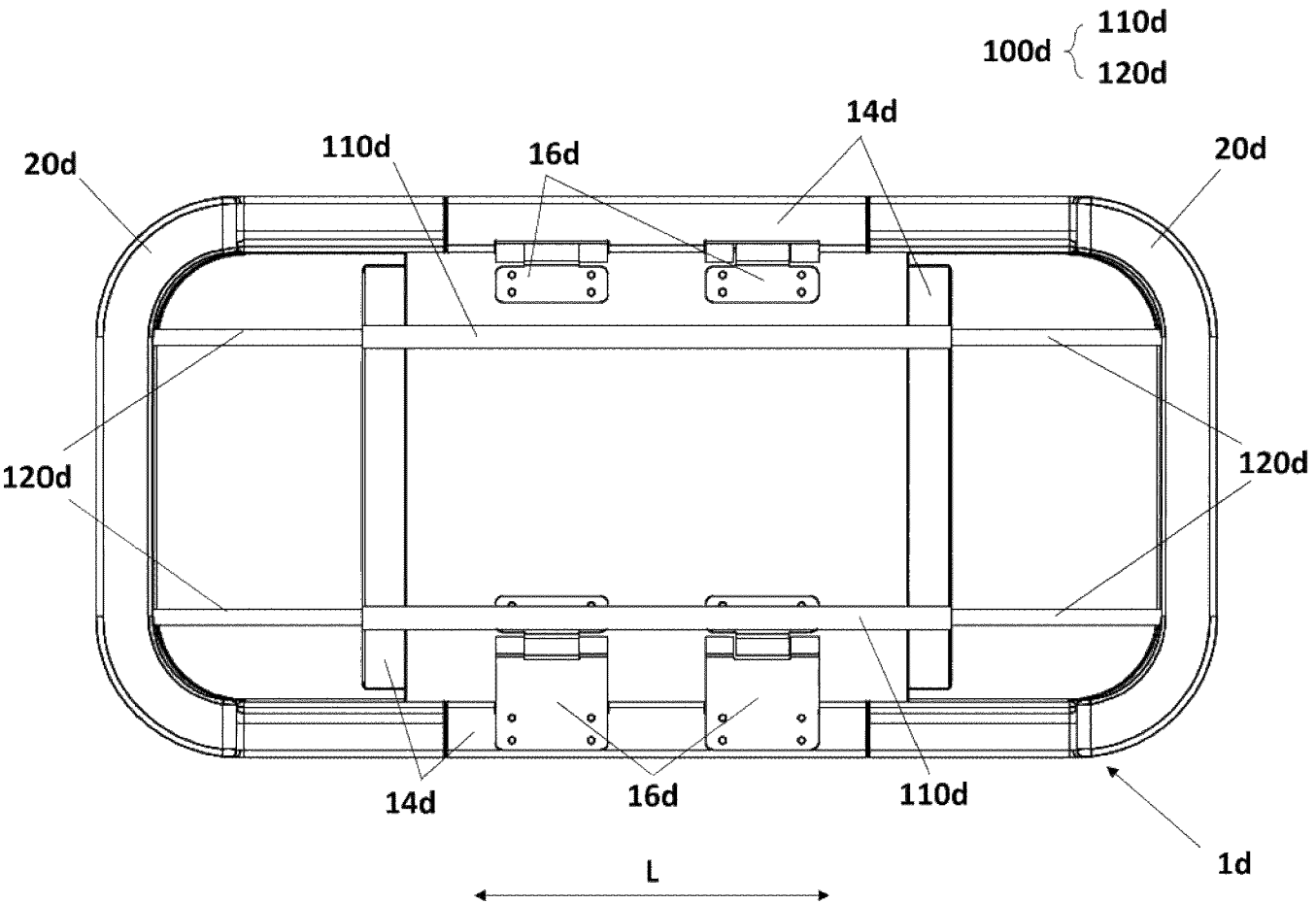
FIG. 23 is a schematic bottom view of the baby carrier of FIG. 22 with a base portion removed and a part of the folding portion folded.

Referring to FIGS. 21 to 23, FIG. 21 is a perspective schematic view of a baby carrier in an unfolded state to which folding mechanisms according to a fifth embodiment of the present disclosure are applied, FIG. 22 is a schematic bottom view of the baby carrier of FIG. 21, and FIG. 23 is a schematic bottom view of the baby carrier of FIG. 22 with a base portion removed and a part of the folding portion folded. The folding mechanism 1*d* of this embodiment is applicable to a baby carrier 2*d*, which is a portable sleeping box or cradle and includes a first part 10*d* and a second part 20*d*, wherein the first part 10*d* includes a base portion 12*d* and a plurality of folding portions 14*d* pivotally connected to the base portion 12*d*, and the base portion 12*d*, at least one of the folding portions 14*d* and the second part 20*d* are sequentially arranged in the longitudinal direction L. Preferably, the baby carrier 2*d* further includes a handle 30*d*, wherein the handle 30*d* is connected to two folding portions 14*d* which are coplanar with the second part 20*d*, and can be held by the user to facilitate carrying the baby carrier 2*d*. Hereinafter, for a clearer explanation, the folding portion 14*d* to which the handle 30*d* is connected will be referred to as a side folding portion, and the folding portion 14*d* arranged sequentially with the base portion 12*d* and the second part 20*d* in the longitudinal direction L will be referred to as a bottom folding portion.

As shown in FIG. 23, the folding mechanism 1*d* includes a connecting element 100*d*, wherein the second part 20*d* is slidably connected to the base portion 12*d* through the connecting element 100*d*, and an extending direction of the connecting element 100*d* is parallel to the longitudinal direction L. In detail, the connecting element 100*d* of this embodiment is a pipe element and includes a first pipe 110*d* and a second pipe 120*d*, wherein the first pipe 110*d* is arranged on the base portion 12*d* and formed with a cavity 112*d* (see FIG. 24), and the second pipe 120*d* is connected to the second part 20*d* and slidably disposed in the cavity 112*d*. Furthermore, the first pipe 110*d* is embedded in the base portion 12*d*, and thus the bottom of the baby carrier 2*d* can be kept flat and arrangement of the connecting element 100*d* will not increase an additional thickness of the base portion 12*d*. With this arrangement, after the bottom folding portion and the side folding portion are pivoted and folded relative to the base portion 12*d*, the second part 20*d* will slide towards the base portion 12*d* along with the second pipe 120*d* sliding into the cavity 112*d*, thus achieving the effect of folding the baby carrier 2*d*. Preferably, the folding mechanism 1*d* further includes a pivot 16*d*, wherein the pivot 16*d* is, for example, a hinge or gemel, which assist the side folding portion to pivot and fold relative to the base portion 12*d*.

Figure 24:
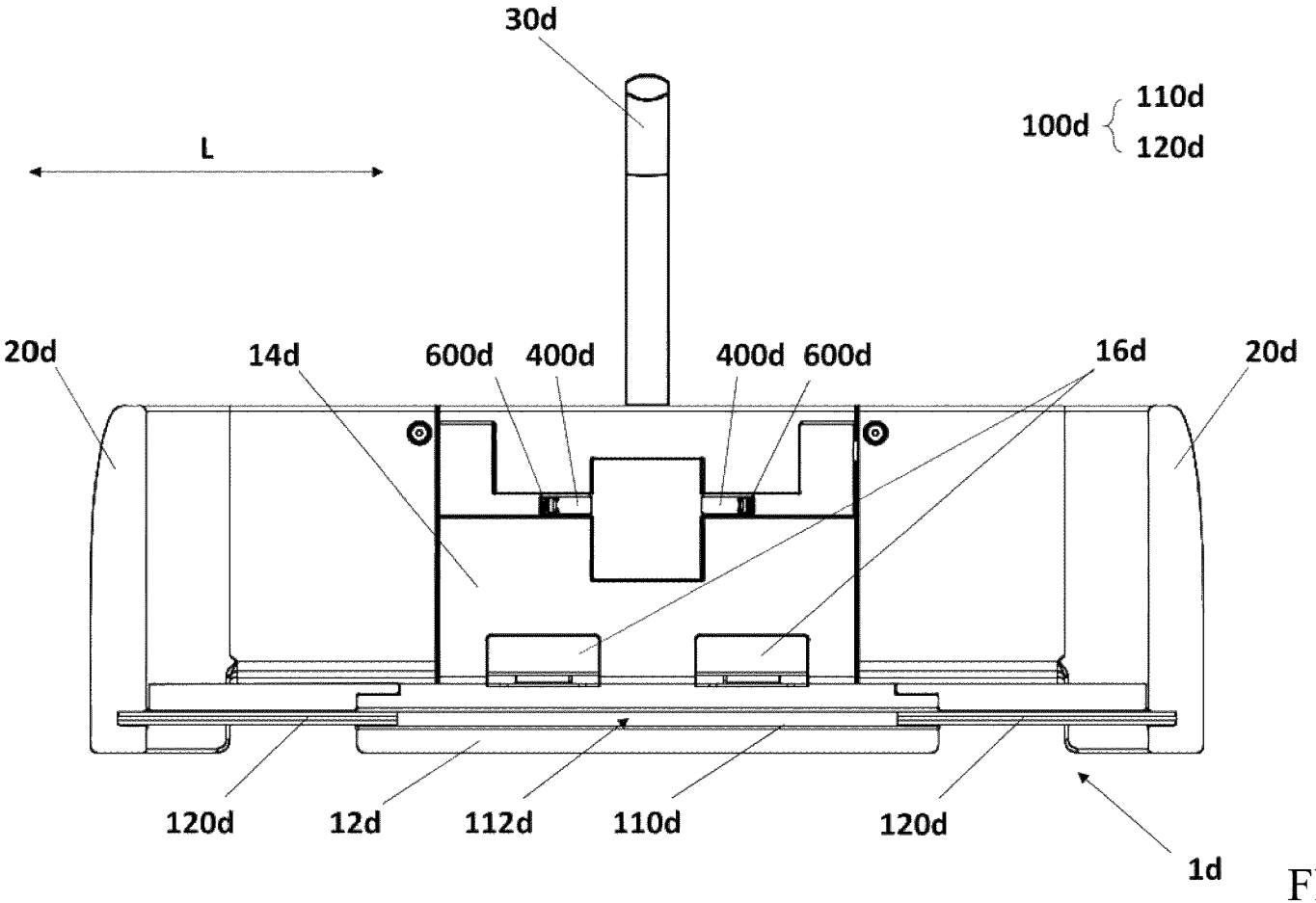
FIG. 24 is a schematic cross-sectional view of the baby carrier of FIG. 21.
Figure 25:
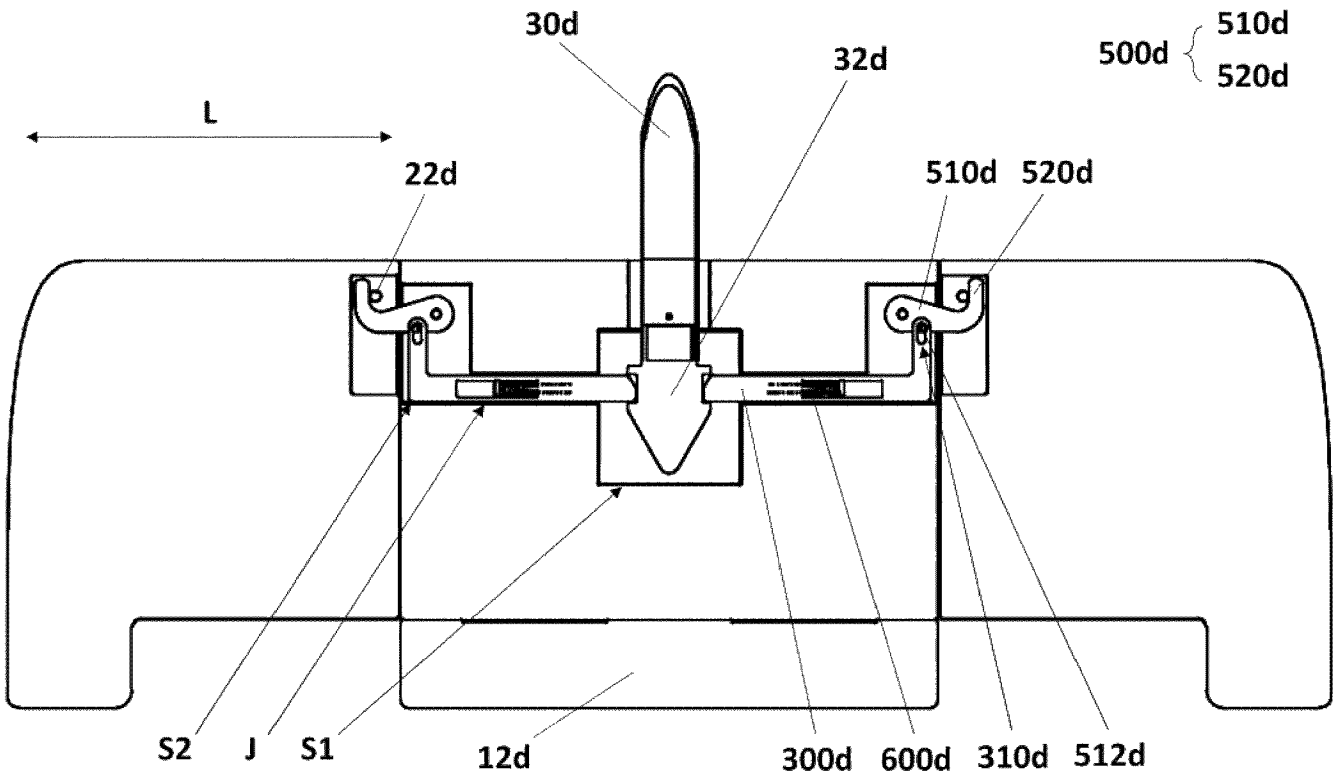
FIG. 25 is a schematic view of internal components of the baby carrier of FIG. 21.
Figure 26:
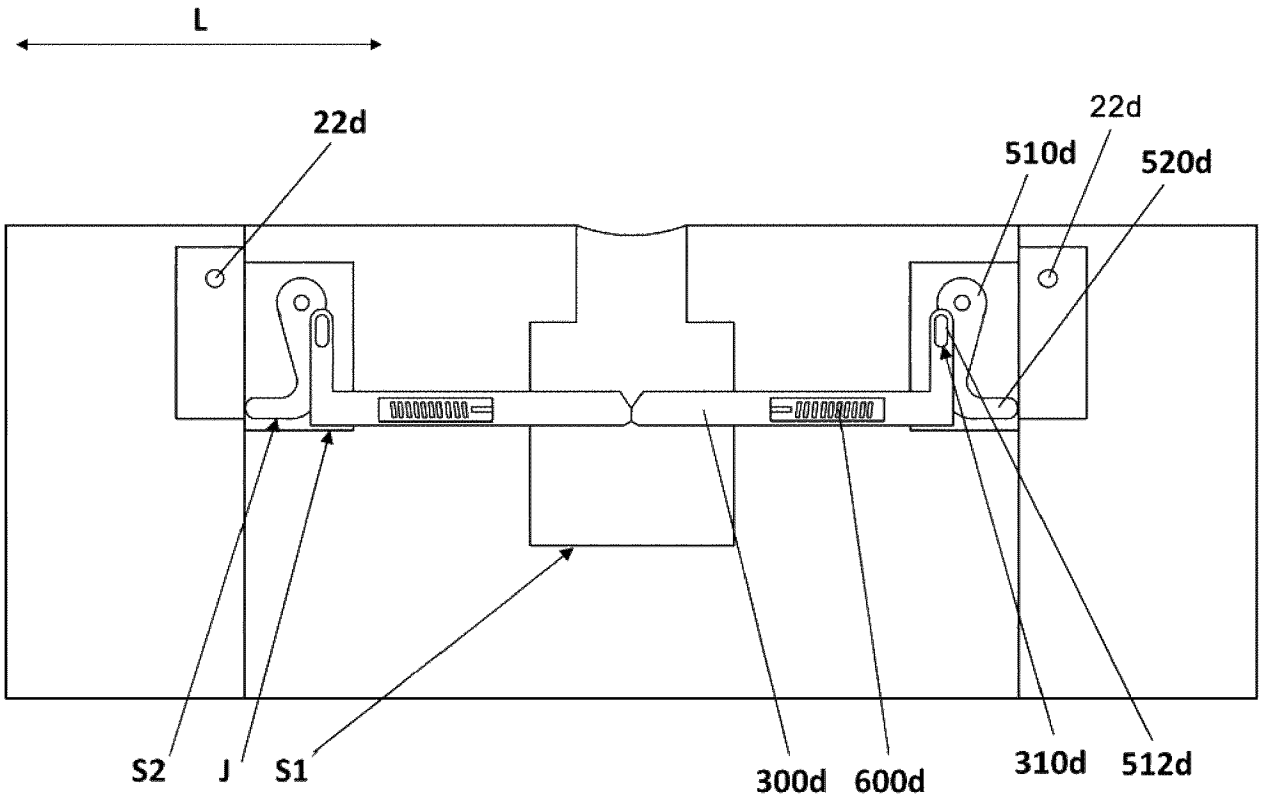
FIG. 26 is a schematic view of the internal components of the baby carrier of FIG. 25 after the connecting elements are folded.
Figure 27:
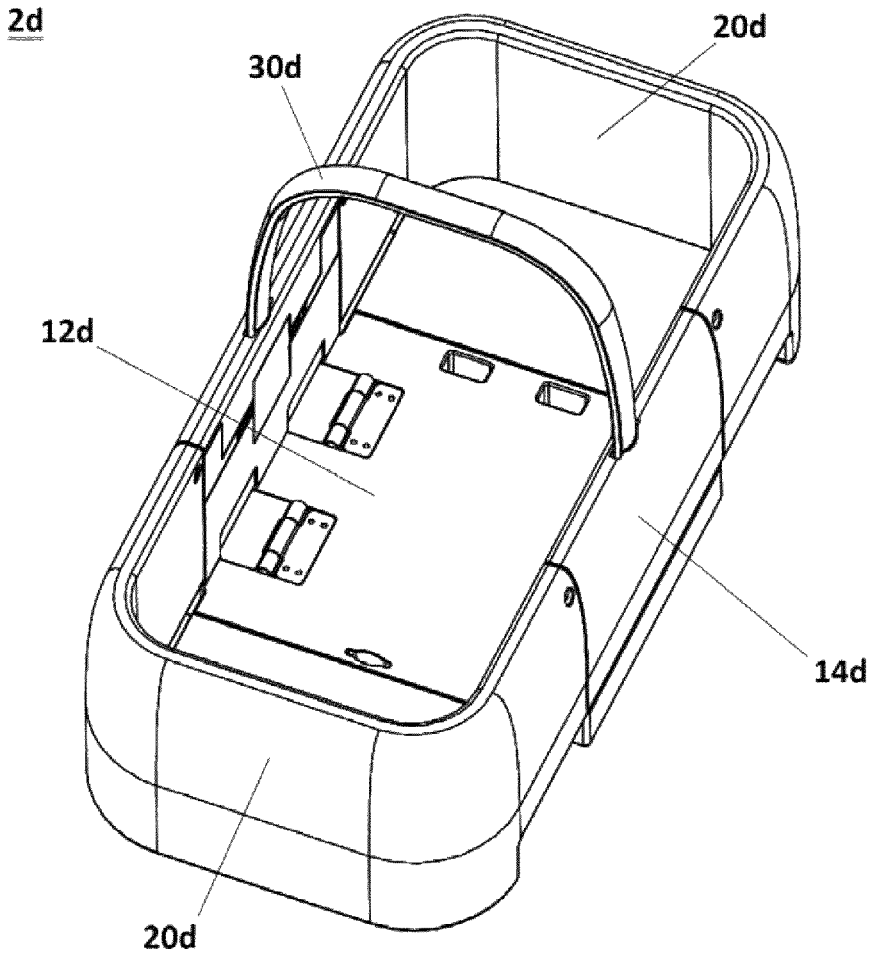
FIG. 27 is a perspective schematic view of the baby carrier of FIG. 21 from another perspective.

In addition to the above-mentioned effects, the folding mechanism 1*d* of this embodiment also has a locking function of locking the first part 10*d* and the second part 20*d* in the unfolded state and an unlocking function of releasing the above-mentioned locking. Referring to FIGS. 24 to 26, FIG. 24 is a cross-sectional schematic view of the baby carrier of FIG. 21, FIG. 25 is a schematic view of internal components of the baby carrier of FIG. 21, and FIG. 26 is a schematic view of the internal components of the baby carrier of FIG. 25 after the connecting elements are folded. In detail, the folding mechanism 1*d* of this embodiment further includes a driving element 300*d*, an operating element 400*d*, and a locking element 500*d*, wherein the driving element 300*d* is arranged on the side folding portion to drive the locking element 500*d* to lock or unlock the baby carrier 2*d*: the operating element 400*d* is connected to the driving element 300*d* and protrudes or recesses relative to a surface of the side folding portion, so as to facilitate a user to grasp or grip and thus operate the driving element 300*d*; and the locking element 500*d* is pivotally connected to the side folding portion and selectively clamped to the second part 20*d*.

Specifically, the side folding portion is formed with a first accommodating space S1, second accommodating spaces S2, and a sliding groove J, wherein the first accommodating space S1 is arranged at a central part of the side folding portion, and two second accommodating spaces S2 are arranged at left and right sides of the side folding portion respectively, and the sliding groove J is communicated with the first accommodating space S1 and the second accommodating spaces S2. Preferably, an extending direction of the sliding groove J is parallel to the longitudinal direction L, and the driving element 300*d* and the locking element 500*d* are respectively embedded in the sliding groove J and the second accommodating spaces S2 inside the side folding portion. As shown in FIGS. 25 and 26, the driving element 300*d* is formed with a limit groove 310*d*, and the locking element 500*d* includes an extending portion 510*d* and a bending portion 520*d*, wherein the extending portion 510*d* is formed with a limit feature 512*d*, such as a bump or a convex column, the bending portion 520*d* is bent relative to the extending portion 510*d*, and the limit feature 512*d* is slidably disposed in the limit groove 310*d*. On the other hand, the second part 20*d* includes a locking portion 22*d*, wherein the locking portion 22*d* is, for example, a convex point or a convex column fixedly disposed inside a wall surface of the second part 20*d*. When the baby carrier 2*d* is in the unfolded state, the bent portion 520*d* is clamped to the locking portion 22*d*, so that the second portion 20*d* is abutted against by the locking element 500*d* and the side folding portion in the longitudinal direction L and fixed relative to the first portion 10*d*.

Preferably, the handle 30*d* of this embodiment is formed with positioning portion(s) 32*d*, wherein the positioning portion 32*d* is, for example, a groove corresponding to a shape of one end of the driving element 300*d*. When the baby carrier 2*d* is in the unfolded state, a part of the handle 30*d* including the positioning portions 32*d* penetrates through the first accommodating space S1, and one end of the driving element 300*d* at each of left and right sides is clamped to one of the positioning portions 32*d*, thereby completely locking the baby carrier 2*d*. When the user wishes to release the locked state and fold the baby carrier 2*d*, driving elements 300*d* may slide along the sliding groove J to the left and right sides of the side folding portion for a certain distance through the operating portion 400*d*, so that the driving element 300*d* is separated from the positioning portion 32*d*, and then the handle 30*d* is pulled out of the side folding portion, so that the driving elements 300*d* on both sides may slide along the sliding groove J towards the first accommodating space S1 and abut against each other. At this time, the locking element 500*d* will be driven by the limit groove 310*d* through the limit feature 512*d*, so that the bending portion 520*d* is pivoted and rotated into the second accommodating space S2. Therefore, the bending portion 520*d* of the locking element 500*d* will no longer be clamped to the locking portion 22*d* of the second part 20*d*, so that the side folding portion may pivot relative to the base portion 12*d*.

Preferably, the folding mechanism 1*d* further includes an elastic element 600*d*, wherein the elastic element 600*d* is arranged between the side folding portion and the driving element 300*d*. With this arrangement, when the user pulls the operating portion 400*d* and pulls out the handle 30*d*, the driving element will automatically take the locking element 500*d* away from the second part 20*d* due to the reset abutment of the elastic element 600*d*, thereby releasing the clamping, and eliminating the process that the user needs to pull the driving element 300*d* by himself. When the user inserts the handle 30*d* into the first accommodating space S1 again, the driving elements 300*d* abutted against each other may temporarily slide towards both sides of the side folding portion under the elastic force of the elastic member 300*d*, and is automatically clamped into the positioning portion 32*d*.

Figure 28:
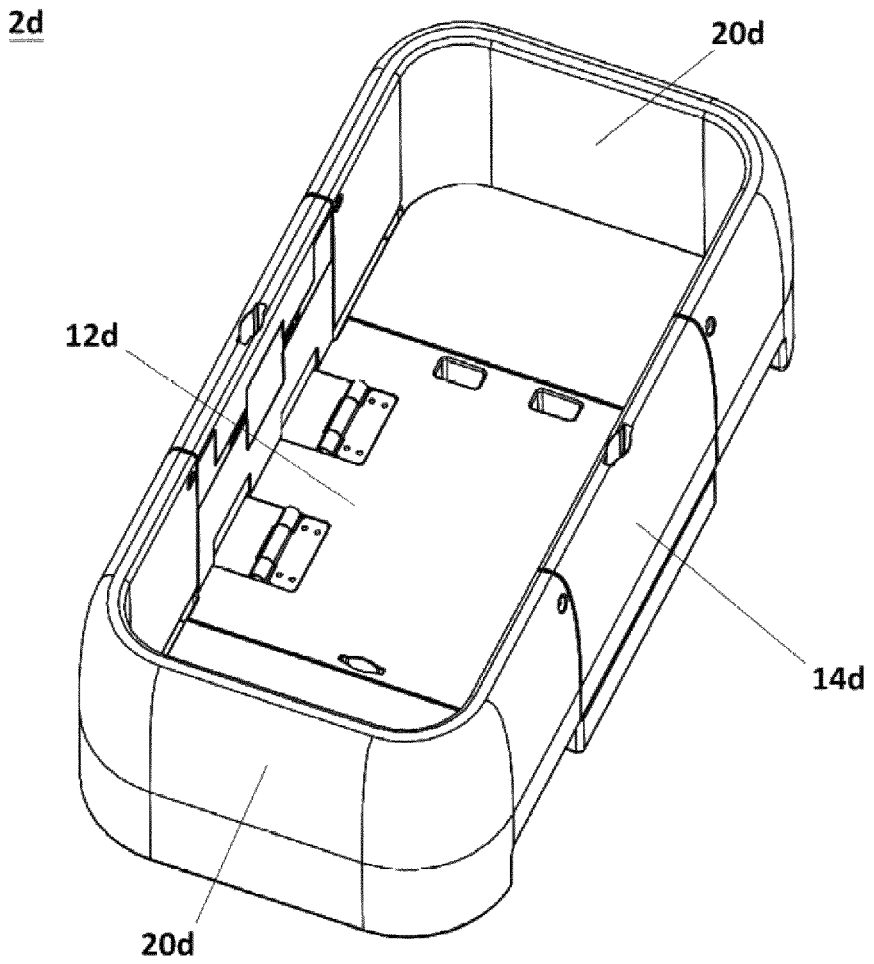
FIG. 28 is a schematic view of a first step of a process from the unfolded state to the folded state of the baby carrier of FIG. 21.
Figure 29:
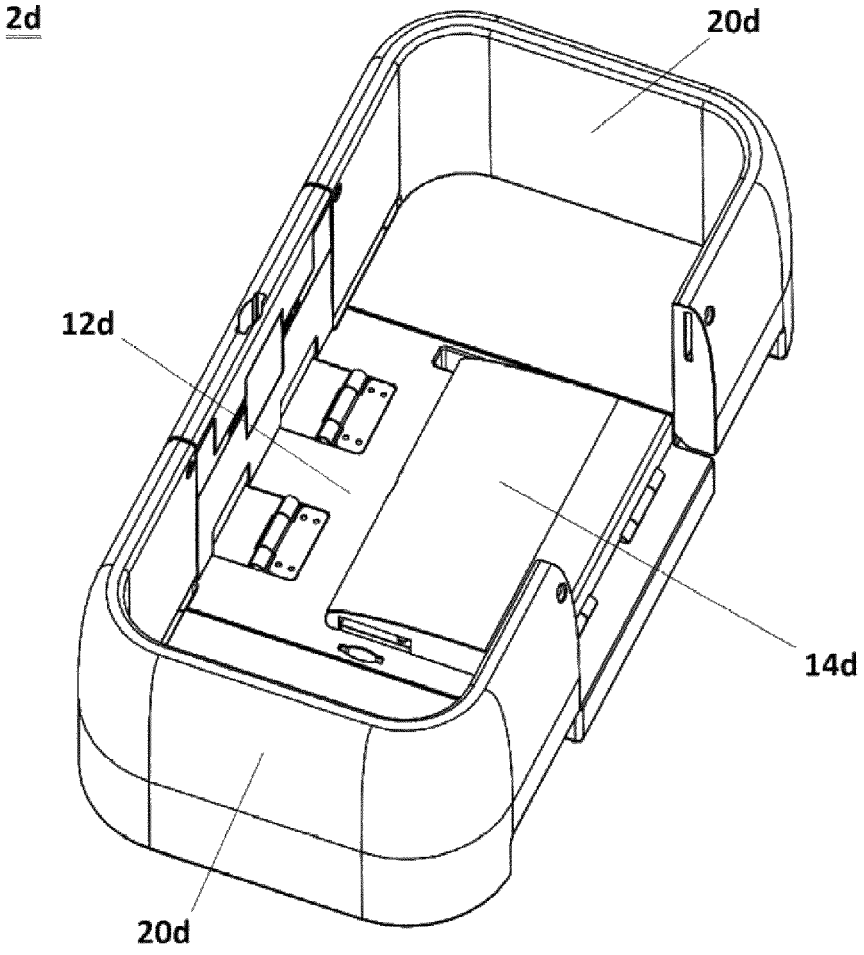
FIG. 29 is a schematic view of a second step of the process from the unfolded state to the folded state of the baby carrier of FIG. 21.
Figure 30:
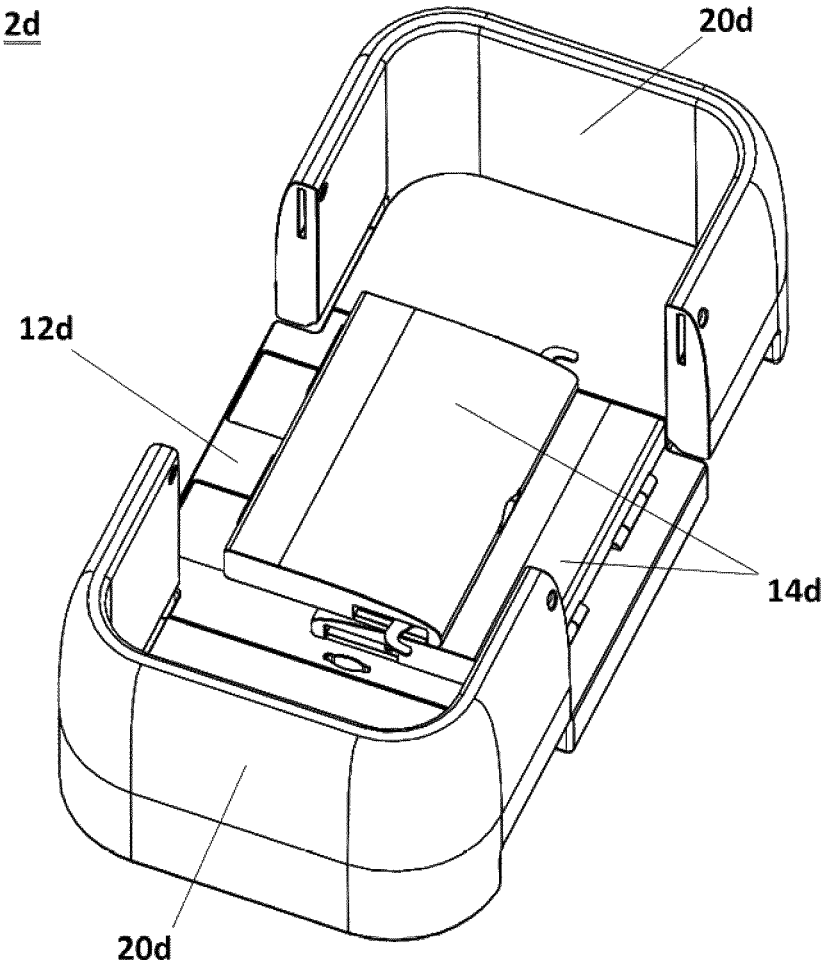
FIG. 30 is a schematic view of a third step of the process from the unfolded state to the folded state of the baby carrier of FIG. 21.
Figure 31:
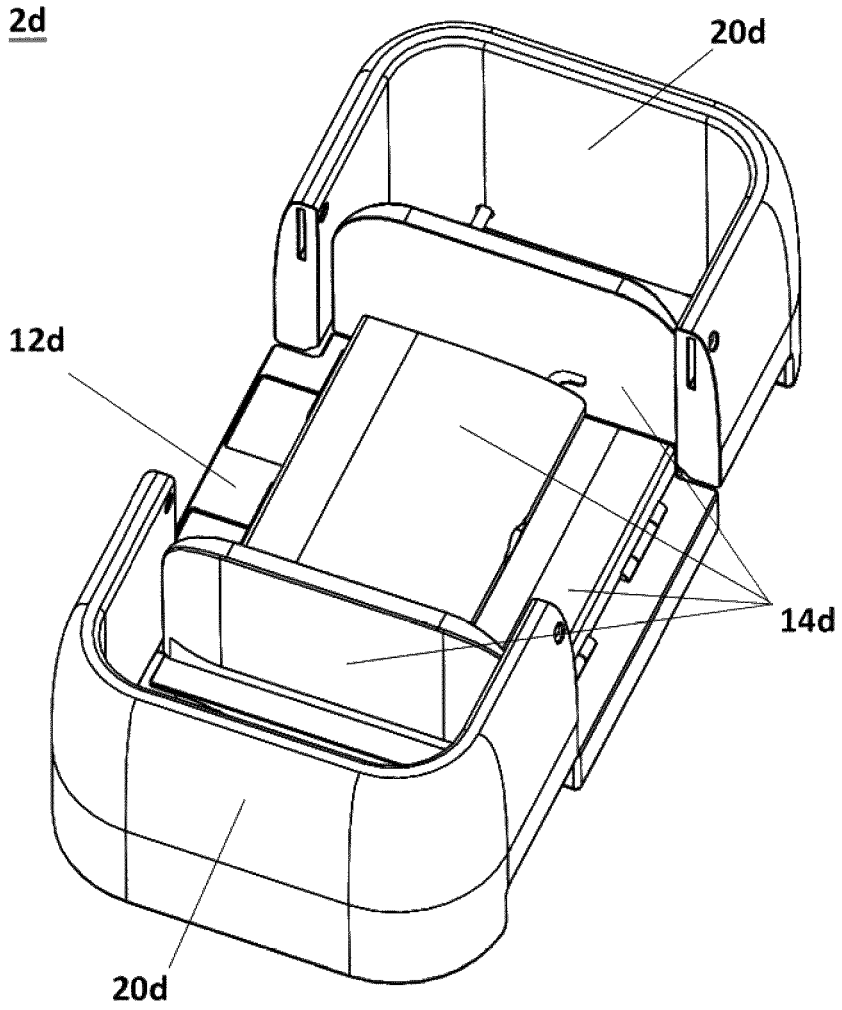
FIG. 31 is a schematic view of a fourth step of the process from the unfolded state to the folded state of the baby carrier of FIG. 21.
Figure 32:
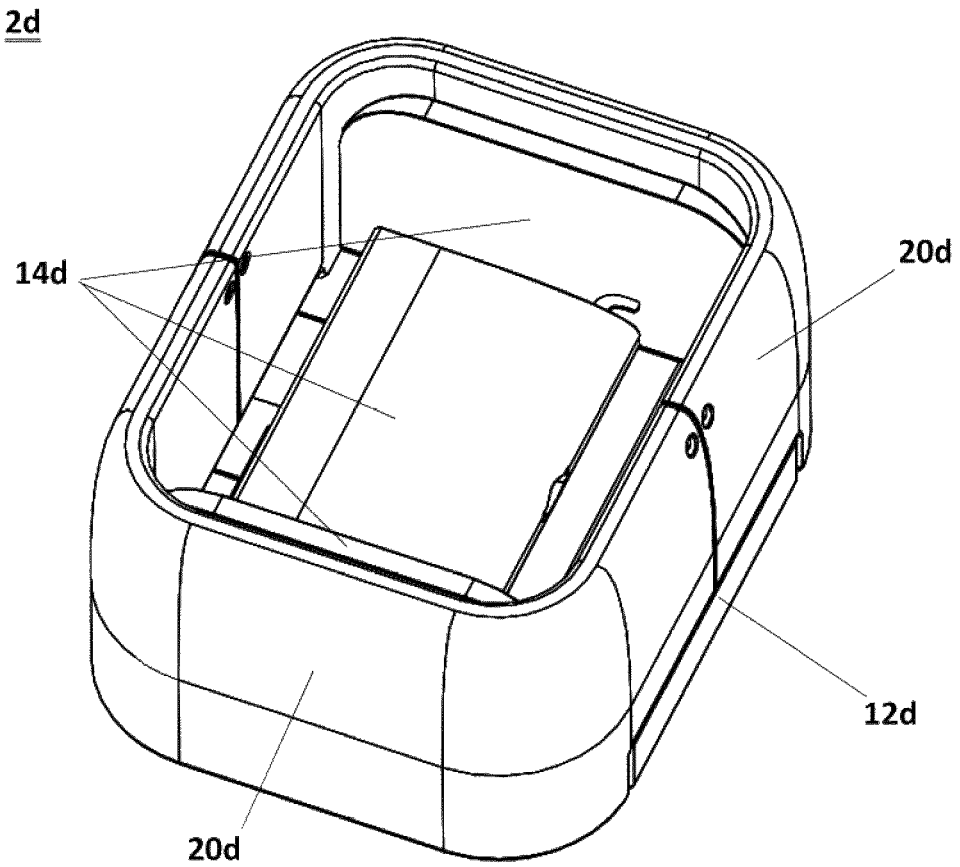
FIG. 32 is a perspective schematic view of the baby carrier of FIG. 21 in a folded state.

FIGS. 27 to 32 are schematic views showing step-by-step flow of the baby carrier of FIG. 21 from the unfolded state to the folded state. First, the user may pull the operating portion inside the folding portion 14*d* (side folding portion), move the driving elements 300*d* to both sides of the side folding portions, and pull the handle 30*d* away from the side folding portions as shown in FIG. 28. After the user's hand releases, the driving element 300*d* will be pushed by the elastic element 600*d* to drive the locking element 500*d* to screw into the side folding portion. At this time, the user may fold the side folding portions on both sides relative to the base portion 12*d* as shown in FIGS. 29 and 30. Then, as shown in FIG. 31, the bottom folding portion is folded relative to the base portion 12*d* to make room for the second part 20*d* to slide, and then the second part 20*d* along with the second pipe 120*d* slides towards a central part of the base portion 12*d*, forming the folded state as shown in FIG. 32.

Compared with the related art, the folding mechanism 1 of the present disclosure includes a first connecting element 100 and a second connecting element 200, which are pivotally connected to the first part 10 and the second part 20, respectively, and selectively clamped to the locking portion 510 through the limit portion 310, so that the first part 10 may be folded relative to the second part 20. In addition, extending directions of the connecting elements 100*a*, 100*b*, 100*c* and 100*d* of the folding mechanisms 1*a*, 1*b*, 1*c* and 1*d* of the present disclosure are parallel to the longitudinal direction L of the first parts 10*a*, 10*b*, 10*c* and 10*d* and the second parts 20*a*, 20*b*, 20*c* and 20*d*, respectively, so that the second parts 20*a*, 20*b*, 20*c* and 20*d* may be pivoted, detached or slid and folded relative to the first parts 10*a*, 10*b*, 10*c* and 10*d*, respectively, thereby greatly reducing a volume occupied by any of the baby carriers 2*a*, 2*b*, 2*c* and 2*d* and improving the use convenience.

The present disclosure has been described in connection with the above preferred embodiments, however, the present disclosure is not limited to the above disclosed embodiments, and should cover various modifications and equivalent combinations according to the essence of the present disclosure.

What is claimed is:

1. A baby carrier assembly comprising:

a baby carrier comprising a first part and a second part arranged in a longitudinal direction; and a folding mechanism comprising a connecting element, wherein the second part is movably connected to the first part-through the connecting element, wherein an extending direction of the connecting element being parallel to the longitudinal direction, wherein each of the first part and the second part comprises a bottom plate, wherein the connecting element is pivotally connected to the bottom plate of the first part and the bottom plate of the second part, respectively, and wherein a through groove is provided on the bottom plate of the second part and communicated with an upper surface and a lower surface of the bottom plate of the second part.

2. The baby carrier assembly according to claim 1, wherein a length of the second part in the longitudinal direction is less than or equal to a length of the first part in the longitudinal direction, an accommodating groove is formed on the bottom plate of the first part and recessed relative to an upper surface of the bottom plate of the first part, and the connecting element penetrates through the accommodating groove and the through groove.

3. The baby carrier assembly according to claim 1, wherein the folding mechanism further comprises a first limit element and a second limit element, wherein the first limit element and the second limit element are respectively fixed, pivoted or clamped on the bottom plate of the first part and the bottom plate of the second part, and wherein the connecting element is sleeved on the first limit element and the second limit element.

4. The baby carrier assembly according to claim 1, wherein the length of the second part in the longitudinal direction is less than or equal to a length of the first part in the longitudinal direction, wherein each of the first part and the second part further comprises a side wall, each of which surrounds the corresponding bottom plate, wherein the folding mechanism is adapted to switch the baby carrier between an unfolded state and a folded state, wherein the bottom plate of the second part is abutted against and coplanar with the bottom plate of the first part in the unfolded state, and wherein the bottom plate and the side wall of the second part are respectively superposed on the bottom plate and the side wall of the first part in the folded state.

5. The baby carrier assembly according to claim 1, wherein the folding mechanism further comprises a connecting hole, wherein each of the first part and the second part comprises an end face, wherein the connecting element is fixedly disposed on one of the first part and the second part and protrudes relative to the corresponding end face, wherein the connecting hole is formed on the end face of the other of the first part and the second part, and wherein the connecting hole is positioned to correspond to the connecting element.

6. The baby carrier assembly according to claim 1, wherein the length of the second part in the longitudinal direction is less than or equal to the length of the first part in the longitudinal direction, wherein the connecting element is fixedly disposed on the second part, and wherein a length of the connecting element protruding relative to an end face of the second part is less than a length difference between the first part and the second part in the longitudinal direction.

7. The baby carrier assembly according to claim 1, wherein each of the first part and the second part comprises a bottom plate and a side wall, and wherein each side wall surrounds the corresponding bottom plate, wherein the connecting element is arranged outside of at least one of the bottom plate and the side wall of the second part and comprises a sliding portion, wherein at least one of the bottom plate and the side wall of the first part is formed with a sliding rail or sliding groove, and wherein the sliding portion is slidably disposed on the sliding rail or sliding groove.

8. The baby carrier assembly according to claim 7, wherein the connecting element further comprises a fixing portion, wherein the sliding portion is pivotally connected to the fixing portion, and wherein the connecting element is fixedly disposed outside of at least one of the bottom plate and the side wall of the second part through the fixing portion.

9. The baby carrier assembly according to claim 1, wherein the folding mechanism further comprises an operating element and at least one locking element, wherein the operating element is arranged on one of the first part and the second part and formed with at least one limit groove, wherein the at least one locking element comprises a locking portion and a limit portion, wherein the limit portion is slidably disposed in the at least one limit groove, wherein the other of the first part and the second part is formed with a plurality of locking holes, and wherein the locking portion is selectively clamped in the locking holes.

10. The baby carrier assembly according to claim 9, wherein the folding mechanism further comprises an elastic element, wherein the locking element and the limit groove are provided in plural, and wherein the elastic element is arranged between the operating element and the plurality of the locking elements.

11. The baby carrier assembly according to claim 9, wherein an extending direction of the at least one locking element is inclined relative to the longitudinal direction, and wherein an extending direction of the at least one limit groove is inclined relative to the longitudinal direction and the extending direction of the at least one locking element.

12. The baby carrier assembly according to claim 9, wherein the operating element is disposed outside of the bottom plate of the second part, wherein the locking holes are arranged on a side of the accommodating groove, and wherein the operating element and the at least one locking element are slidably disposed in the accommodating groove.

13. A baby carrier assembly comprising:

a baby carrier comprising a first part and a second part; and a folding mechanism, wherein the first part comprises a base portion and a plurality of folding portions, wherein the plurality of folding portions are pivotally connected to the base portion, wherein, in an unfolded configuration of the baby carrier assembly, the base portion, at least one of the folding portions, and the second part are sequentially arranged in a longitudinal direction, wherein the folding mechanism comprises a connecting element, wherein the second part is slidably connected to the base portion through the connecting element, and wherein, in the unfolded configuration of the baby carrier assembly, an extending direction of the connecting element is parallel to the longitudinal direction.

14. The baby carrier assembly according to claim 13, wherein the folding mechanism further comprises:

a locking element pivotally connected to one of the folding portions and comprising an extending portion provided with a limit feature thereon and a bending portion bent relative to the extending portion, the second part comprising a locking portion, and the bending portion being selectively clamped to the locking portion;

a driving element arranged on one of the folding portions and formed with a limit groove, the limit feature being slidably disposed in the limit groove; and an operating element connected to the driving element and protruding or recessing relative to a surface of one of the folding portions.

15. The baby carrier assembly according to claim 14, wherein the folding mechanism further comprises an elastic element, and wherein the elastic element is arranged between one of the folding portions and the driving element.

16. The baby carrier assembly according to claim 14, wherein the driving element and the locking element are embedded inside one of the folding portions.

17. The baby carrier assembly according to claim 14 wherein the baby carrier further comprises a handle formed with a positioning portion, and wherein an end of the driving element is selectively clamped to the positioning portion.

18. The baby carrier assembly according to claim 17, wherein one of the folding portions is formed with a first accommodating space, a second accommodating space and a sliding groove, wherein the second accommodating space is arranged at a side of one of the folding portions, wherein the sliding groove is communicated with the first accommodating space and the second accommodating space, wherein a part of the handle penetrates through the first accommodating space, wherein the driving element is slidably disposed in the sliding groove, and wherein at least a part of the locking portion is accommodated in the second accommodating space.

19. The baby carrier assembly according to claim 18, wherein an extending direction of the sliding groove is parallel to the longitudinal direction.

20. A baby carrier assembly comprising:

a baby carrier comprising a first part and a second part; and a folding mechanism, wherein the first part comprises a base portion and a plurality of folding portions, wherein the plurality of folding portions are pivotally connected to the base portion, wherein the base portion, at least one of the folding portions, and the second part are sequentially arranged in a longitudinal direction, wherein the folding mechanism comprises a connecting element, wherein the second part is slidably connected to the base portion through the connecting element, wherein an extending direction of the connecting element is parallel to the longitudinal direction, wherein the connecting element is a pipe element and comprises a first pipe and a second pipe, wherein the first pipe is arranged at the base portion and formed with a cavity, and wherein the second pipe is connected to the second part and slidably disposed in the cavity.

21. The baby carrier assembly according to claim 20, wherein the first pipe is embedded inside the base portion.

* * * * *